US008807681B2

(12) United States Patent
Saita et al.

(10) Patent No.: US 8,807,681 B2
(45) Date of Patent: Aug. 19, 2014

(54) INKJET RECORDING APPARATUS AND METHOD FOR CONTROLLING THE SAME

(71) Applicant: Fujifilm Corporation, Tokyo (JP)

(72) Inventors: Hirofumi Saita, Kanagawa (JP); Kazuaki Okamori, Kanagawa (JP); Yasuhiko Kachi, Kanagawa (JP); Kazuo Sanada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/916,463

(22) Filed: Jun. 12, 2013

(65) Prior Publication Data

US 2013/0335469 A1 Dec. 19, 2013

(30) Foreign Application Priority Data

Jun. 13, 2012 (JP) ..... 2012-133939

(51) Int. Cl.

| | |
|---|---|
| ***B41J 29/38*** | (2006.01) |
| ***B41J 2/15*** | (2006.01) |
| ***B41J 11/00*** | (2006.01) |
| ***B41J 2/155*** | (2006.01) |
| *B41J 3/54* | (2006.01) |

(52) U.S. Cl.

CPC ..... *B41J 11/002* (2013.01); *B41J 2/155* (2013.01); *B41J 3/54* (2013.01)

USPC ..... 347/12; 347/40

(58) Field of Classification Search

CPC .. B41J 11/002; B41J 2202/21; B41J 2/04501; B41J 2/155; B41J 3/54

USPC ..... 347/12, 40–43, 102

See application file for complete search history.

(56) References Cited

U.S. PATENT DOCUMENTS

| | | | | |
|---|---|---|---|---|
| 6,027,202 | A | 2/2000 | Narushima | |
| 8,322,840 | B2 * | 12/2012 | Okamori | 347/102 |
| 2005/0156965 | A1 | 7/2005 | Hoshino | |
| 2007/0040885 | A1 | 2/2007 | Kusunoki | |
| 2012/0105532 | A1 | 5/2012 | Sanada | |
| 2012/0120168 | A1 | 5/2012 | Kachi et al. | |

FOREIGN PATENT DOCUMENTS

| | | | |
|---|---|---|---|
| JP | H06-99593 | A | 4/1994 |
| JP | 2003-048318 | A | 2/2003 |
| JP | 2005-262553 | A | 9/2005 |

(Continued)

OTHER PUBLICATIONS

An Office Action; "Notification of Reasons for Rejection," issued by the Japanese Patent Office on Jun. 20, 2014, which corresponds to Japanese Patent Application No. 2012-133939 and is related to U.S. Appl. No. 13/916,463; with English language partial translation.

*Primary Examiner* — An Do

(74) *Attorney, Agent, or Firm* — Studebaker & Brackett PC

(57) ABSTRACT

In an inkjet head which has nozzle rows having nozzles each of which ejects curable inks cured by imparted activation energy and which are arranged in a first direction at a pitch P, the nozzle rows being N (N≥5) nozzle rows of every color which eject, respectively, thick inks of four colors including cyan, magenta, yellow and black, and at least one light ink among light inks similar in color tone to the thick inks, the nozzles in each of the nozzle rows are arranged so as to be shifted by P/N from each other in a first direction, a nozzle of an ink with lowest cure sensitivity is arranged on the most upstream side in a direction of relative movement of a recording medium in the first direction, and further the nozzle of light ink is arranged in between the nozzles of two different thick inks.

13 Claims, 13 Drawing Sheets

(56) References Cited

FOREIGN PATENT DOCUMENTS

| | | | |
|---|---|---|---|
| JP | 2005-262570 | A | 9/2005 |
| JP | 2007-112117 | A | 5/2007 |
| JP | 2007-118409 | A | 5/2007 |
| JP | 2009-078381 | A | 4/2009 |
| JP | 2012-096407 | A | 5/2012 |
| JP | 2012-101492 | A | 5/2012 |
| WO | 97/37854 | A1 | 10/1997 |

* cited by examiner

| | |
|---|---|
| 10 | 5 |
| 9 | 4 |
| 8 | 3 |
| 7 | 2 |
| 6 | 1 |

| | |
|---|---|
| 8 | 3 |
| 10 | 5 |
| 7 | 2 |
| 9 | 4 |
| 6 | 1 |

| | |
|---|---|
| 10 | 5 |
| 4 | 9 |
| 8 | 3 |
| 2 | 7 |
| 6 | 1 |

INKJET RECORDING APPARATUS AND METHOD FOR CONTROLLING THE SAME

BACKGROUND OF THE INVENTION

1. Field of the Invention

The present invention relates to an inkjet recording apparatus and a method for controlling the same, and more particularly relates to a technology of ejecting inks of a plurality of colors for image formation.

2. Description of the Related Art

In a conventional inkjet recording apparatus, nozzles of respective color heads are configured to be arrayed on the same line in a main scanning direction so that arrangement positions of ink dots of the respective colors can be shared.

When such nozzle arrangement is applied to an inkjet recording apparatus using UV curing inks (ultraviolet curable inks), ink dots of all the colors are arrayed on the same line by one main scanning action. As a result, these ink dots may cause landing interference in the main scanning direction, and undesirably form line-like surface shapes having large depressions and projections. Slight shape difference due to these depressions and projections makes uneven glossiness notable.

To solve this problem, a method has been disclosed in Japanese Patent Application Laid-Open No. 2005-262570 in which difference between depressions and projections in an image is reduced by shifting the center position of dots from an ink with low recording density from the center position of dots from an ink with high recording density. Furthermore, a technology for arranging nozzle positions of respective color heads so as to be shifted from each other in a sub-scanning direction has been disclosed in International Publication No. WO 1997/037854.

However, in the method of Japanese Patent Application Laid-Open No. 2005-262570, since the inks with high recording density are deposited on the same identical line, uneven glossiness is not sufficiently improved in an image with high density and high droplet deposition rate (such as a gray-color solid image made up of four colors of cyan, magenta, yellow, and black). Moreover, if the nozzle arrangement disclosed in International Publication No. WO 1997/037854 is applied to an inkjet recording apparatus using UV curing inks, uneven glossiness is still notable depending on a superimposing order of colors since the UV curing inks are different in cure sensitivity between respective colors due to absorption wavelengths of pigments.

Further, a technology to improve image quality is described in Japanese Patent Application Laid-Open No. 2007-118409, in which inkjet heads of the respective colors are placed at different positions, and an ink with the lowermost penetration is first printed and cured before other inks are printed in sequence.

Placing each color head as described in Japanese Patent Application Laid-Open No. 2007-118409 causes upsizing of carriages that carry the heads as well as an UV irradiation light source, which in turns causes deterioration in scan speed and increase in power consumption.

SUMMARY OF THE INVENTION

In an inkjet recording apparatus using UV curing inks and having separated light sources for semi-curing and main curing, it is known that glossiness is increased by reducing a light amount (pinning light amount) of the semi-curing light source. However, if the light amount of the semi-curing light source is reduced, a disadvantage that ink droplets of the respective colors immediately after their ejection are more likely to cause landing interference becomes notable.

In the case of UV curing inks that are likely to cause landing interference, inks of the respective colors are combined and deposited droplets are deformed on a periodic basis, which causes periodic uneven glossiness.

Thus, reducing the light amount of the semi-curing light source so as to increase glossiness and increasing the light amount of the semi-curing light source so as to avoid landing interference contradict each other. Therefore, in the UV curing inks, increasing glossiness and solving the uneven glossiness are the objects difficult to accomplish at the same time.

The present invention has been made in view of such circumstances, and it is an object of the present invention to provide an inkjet recording apparatus, which can suppress uneven glossiness of images and can record high-quality images by adopting nozzle arrangement corresponding to the characteristics of inks, and a method for controlling the same.

In order to accomplish the above object, one aspect of an inkjet recording apparatus includes: an inkjet head which has nozzle rows having nozzles each of which ejects curable inks cured by imparted activation energy and which are arranged in a first direction at a pitch P, the nozzle rows being N ($N \geq 5$) nozzle rows of every color which eject, respectively, thick inks of four colors including cyan, magenta, yellow and black, and at least one light ink among light inks similar in color tone to the thick inks; an activation energy imparting device which imparts the activation energy to ink droplets ejected from the nozzles and deposited on a recording surface of a recording medium; a retention device which disposes and retains the inkjet head and the activation energy imparting device along a second direction orthogonal to the first direction; a scanning device which causes the retention device and the recording medium to relatively scan in the second direction; a movement device which causes the retention device and the recording medium to move in the first direction in every scanning action by the scanning device; and a control device which causes an image to be formed on the recording surface of the recording medium while causing the inkjet head and the activation energy imparting device retained by the retention device to relatively scan each region of the recording medium; wherein the nozzles in each of the nozzle rows in the inkjet head are arranged so as to be shifted by P/N from each other in the first direction, a nozzle of an ink with lowest cure sensitivity is arranged on a most upstream side in a direction of movement of the recording medium relative to the inkjet head in the first direction, and further a nozzle of the light ink is arranged in between the nozzles of two different thick inks, and the control device causes the image to be formed on the recording surface of the recording medium by causing the inks of the nozzles which are arranged on a more upstream side in the direction of relative movement of the recording medium in the first direction to be laid on layers closer to the recording surface of the recording medium.

According to the present aspect, the nozzles in each of the nozzle rows in the inkjet head are arranged so as to be shifted by P/N from each other in the first direction, while a nozzle of an ink with lowest cure sensitivity is arranged on a most upstream side in the direction of movement of the recording medium relative to the inkjet head, and further a nozzle of the light ink is arranged in between the nozzles of two different thick inks, and the control device causes the image to be formed on the recording surface of the recording medium by causing the inks of the nozzles, which are arranged on the more upstream side in the direction of relative movement of the recording medium in the first direction, to be laid on layers closer to the recording surface of the recording medium.

Accordingly, the ink with the lowest cure sensitivity can be laid on the layer closest to the recording surface so as to constantly keep the surface layer in a stable state, while landing interference between the thick inks can be reduced and uneven glossiness can be reduced thereby. In this aspect, a number of times of the relative scan can be set in accordance with conditions such as shape and dimension of the recording medium and the inkjet head, and it is not limited to specific number of times.

The ink with the lowest cure sensitivity may be the black ink. The present aspect is applicable to an ink set having such cure sensitivity.

In each of the nozzle rows in the inkjet head, a nozzle of an ink with the second lowest cure sensitivity is preferably arranged subsequent to the nozzle of the ink with the lowest cure sensitivity from upstream to downstream in the direction of movement of the recording medium relative to the inkjet head. Consequently, the ink with the lowest cure sensitivity is laid on the layer closest to the recording surface, and the ink with the second lowest cure sensitivity is laid on the layer second closest to the recording surface, so that the surface layer can further be kept in a stable state and thereby uneven glossiness can further be reduced.

The ink with the second lowest cure sensitivity may be the yellow ink. The present aspect is applicable to an ink set having such cure sensitivity.

It is preferable that the inkjet head has nozzle rows which eject, respectively, inks of a light cyan color and a light magenta color as the light inks, the nozzles in each of the nozzle rows in the inkjet head are arranged so as to be shifted by P/6 from each other in the first direction, and the nozzle of the light cyan color or the light magenta color is arranged in between the nozzle of the cyan color and the nozzle of the magenta color, between the nozzle of the magenta color and the nozzle of the yellow color, or between the nozzle of the yellow color and the nozzle of the cyan color. The present aspect is applicable to the inkjet recording apparatus which uses inks of light cyan and light magenta colors.

Furthermore, in each of the nozzle rows in the inkjet head, nozzles may be arranged so as to be shifted from each other in the first direction in ascending order of cure sensitivity of inks from upstream to downstream in the direction of movement of the recording medium relative to the inkjet head. Consequently, the inks with lower cure sensitivity can be laid on layers closer to the recording surface of the recording medium, so that the surface layer can constantly be kept in a stable state and uneven glossiness can appropriately be reduced.

The activation energy imparting device preferably imparts the activation energy high enough to imperfectly cure ink droplets deposited on the recording surface of the recording medium in one scanning activity by the scanning device. As a consequence, glossiness can be increased.

It is preferable to include a second activation energy imparting device which further imparts activation energy to the ink droplets imparted with the activation energy by the activation energy imparting device so as to completely cure the ink droplets. As a consequence, the inks can appropriately be cured.

The retention device preferably retains the second activation energy imparting device on a downstream side in the direction of relative movement of the recording medium. As a consequence, the inks can appropriately be cured.

The retention device preferably retains the activation energy imparting device on both sides of the inkjet head in the second direction. As a consequence, the inks can appropriately and imperfectly be cured.

The activation energy may be ultraviolet light. The present aspect is applicable to the inkjet recording apparatus which uses ultraviolet curable inks.

The inkjet head may have nozzle rows which respectively eject inks of clear and white colors, on both sides of the N color nozzle rows in the second direction. The present aspect is applicable to the inkjet recording apparatus which has a clear ink and a white ink.

In order to accomplish the above object, one aspect of a method for controlling an inkjet recording apparatus, the apparatus including: an inkjet head which has nozzle rows each of which ejects, from nozzles arranged in a first direction at a pitch P, curable inks cured by imparted activation energy, the inks being total N color inks including thick inks of cyan, magenta, yellow, and black, and light inks similar in color tone to the thick inks; an activation energy imparting device which imparts the activation energy to ink droplets ejected from the nozzles and deposited on a recording surface of a recording medium; and a retention device which disposes and retains the inkjet head and the activation energy imparting device along a second direction orthogonal to the first direction, the method including: an arrangement step of arranging the nozzles in each of the nozzle rows in the inkjet head so as to be shifted by P/N from each other in the first direction, while arranging a nozzle of an ink with the lowest cure sensitivity on a most upstream side in a direction of movement of the recording medium relative to the inkjet head in the first direction, and arranging a nozzle of the light ink in between nozzles of two different thick inks; and a control step of causing an image to be formed on the recording surface of the recording medium while causing the inkjet head and the activation energy imparting device retained by the retention device to relatively scan each region of the recording medium, in which the image is formed on the recording surface of the recording medium by causing the inks of the nozzles which are arranged on a more upstream side in a direction of relative movement of the recording medium in the first direction to be laid on layers closer to the recording surface of the recording medium.

According to the present aspect, the nozzles in each of the nozzle rows in the inkjet head are arranged so as to be shifted by P/N from each other in the first direction, while the nozzle of the ink with the lowest cure sensitivity is arranged on the most upstream side in the direction of movement of the recording medium relative to the inkjet head in the first direction, and a nozzle of the light ink is arranged in between the nozzles of two different thick inks, and by using the inkjet head, the image is formed on the recording surface of the recording medium by causing the inks of the nozzles, which are arranged on the more upstream side in the direction of relative movement of the recording medium in the first direction, to be laid on layers closer to the recording surface of the recording medium. Consequently, the ink with the lowest cure sensitivity can be laid on the layer closest to the recording surface, so that the surface layer can constantly be kept in a stable state and uneven glossiness can be reduced thereby. In this aspect, a number of times of the relative scan can be set in accordance with conditions such as shape, dimension, and arrangement and the like of the recording medium and the inkjet head, and it is not fixed to specific number of times.

According to the present invention, the surface layer can constantly be kept in a stable state and uneven glossiness can be reduced.

DETAILED DESCRIPTION OF THE PREFERRED EMBODIMENTS

Hereinafter, embodiments of the present invention are described in detail with reference to the accompanying drawings.

First Embodiment

[Outline of Inkjet Recording Apparatus]

Figure 1:
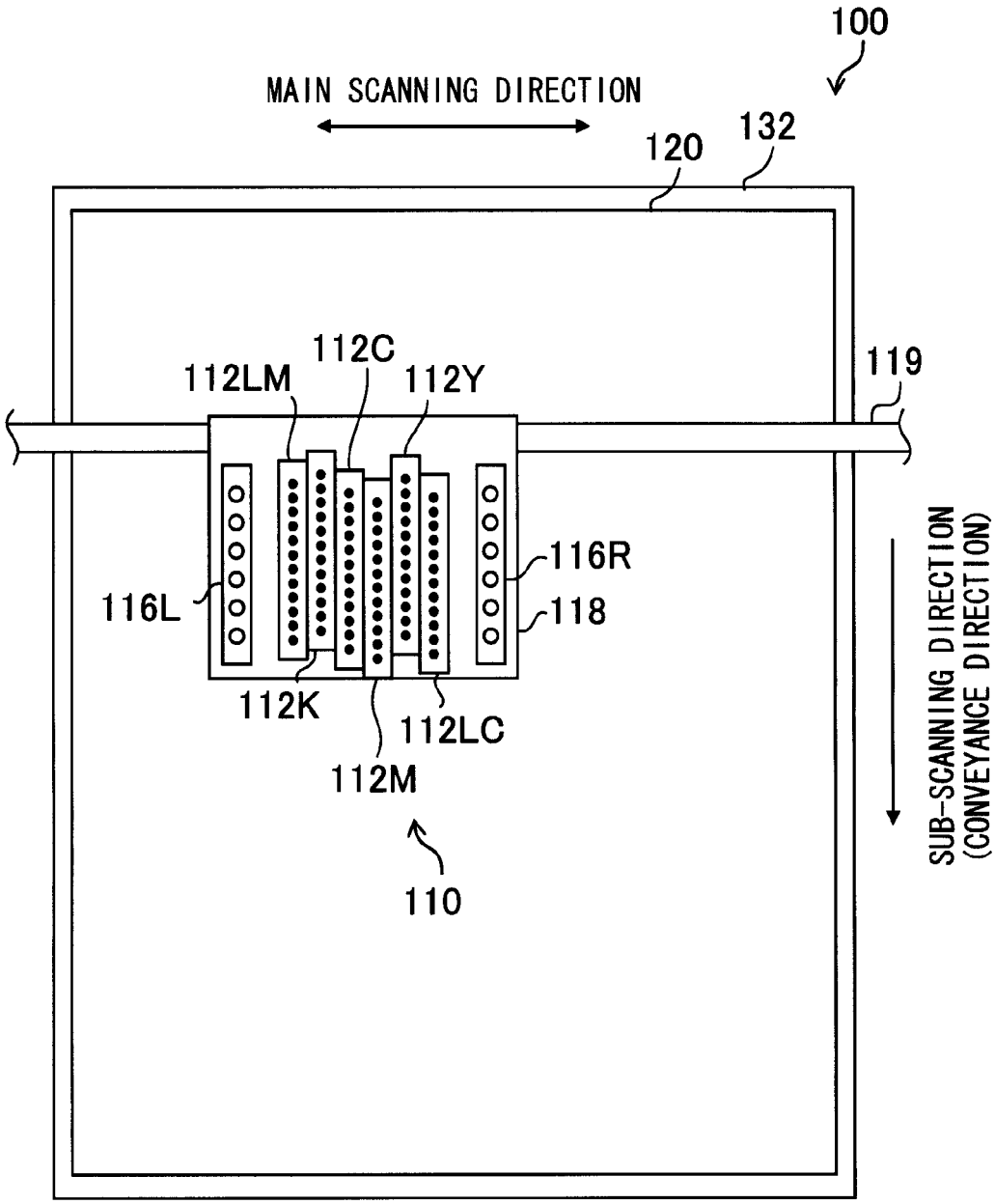
FIG. 1 is an explanatory view for explaining general configuration of an inkjet recording apparatus.
Figure 2:
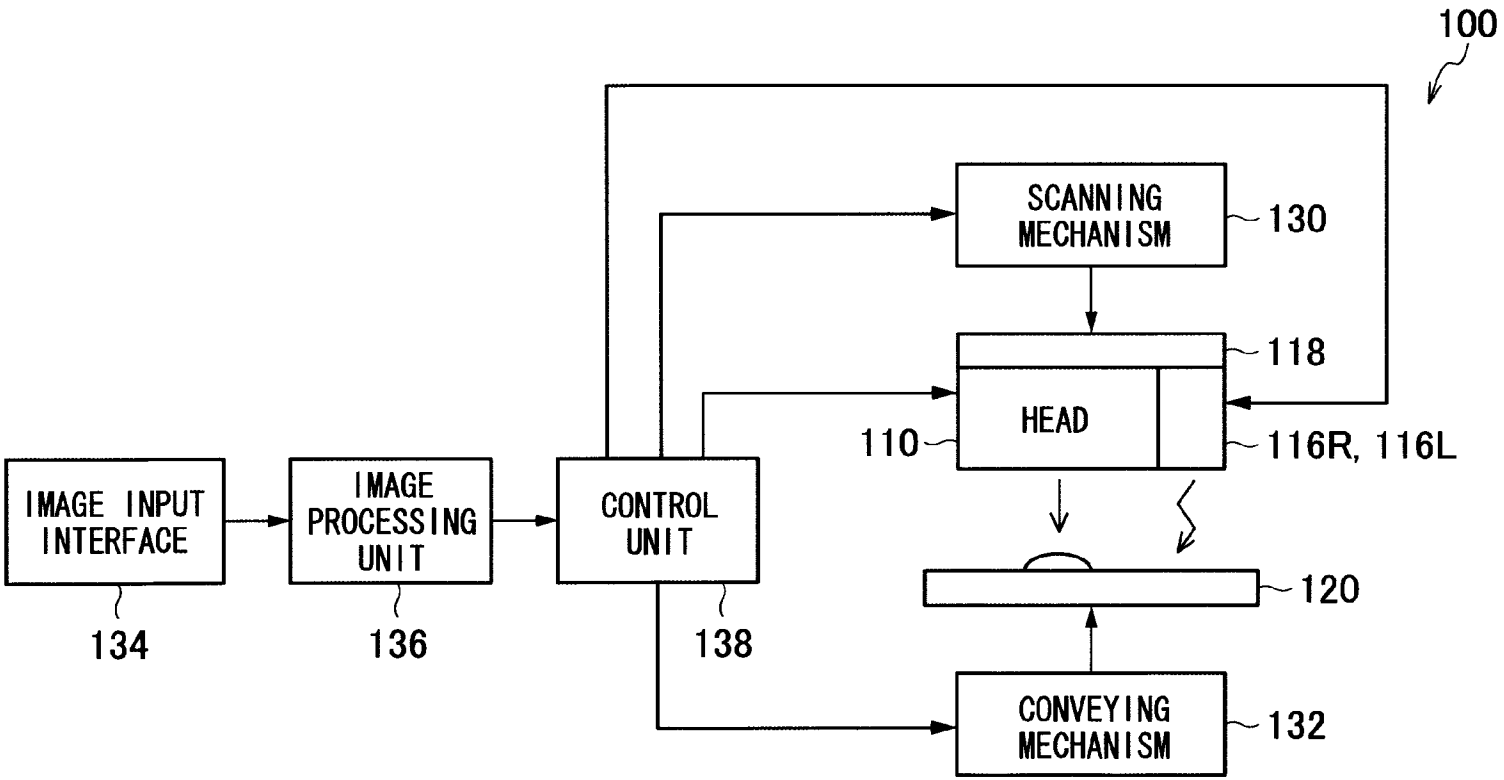
FIG. 2 is a system configuration view of the inkjet recording apparatus.

FIG. 1 is an explanatory view for explaining general configuration of an inkjet recording apparatus 100. FIG. 2 is a system configuration view of the inkjet recording apparatus 100.

The inkjet recording apparatus 100 includes an inkjet head 110, curing light sources 116R and 116L, a carriage 118 (one example of a retention device) carrying these inkjet head 110 and curing light sources 116R and 116L, a carriage scanning mechanism 130 (one example of a scanning device) configured to allow the carriage 118 to scan along a guide 119 which extends in a main scanning direction (corresponding to a second direction), a recording medium conveying mechanism 132 (one example of a movement device) configured to be able to move a recording medium 120, which is placed on an upper surface, in a sub-scanning direction (corresponding to a first direction) orthogonal to the main scanning direction, an image input interface 134 which acquires image data via a wired or wireless communication interface, an image processing unit 136 which performs desired image processing on the inputted image data, and a control unit 138 which collectively controls the inkjet recording apparatus 100, etc.

Figure 3:
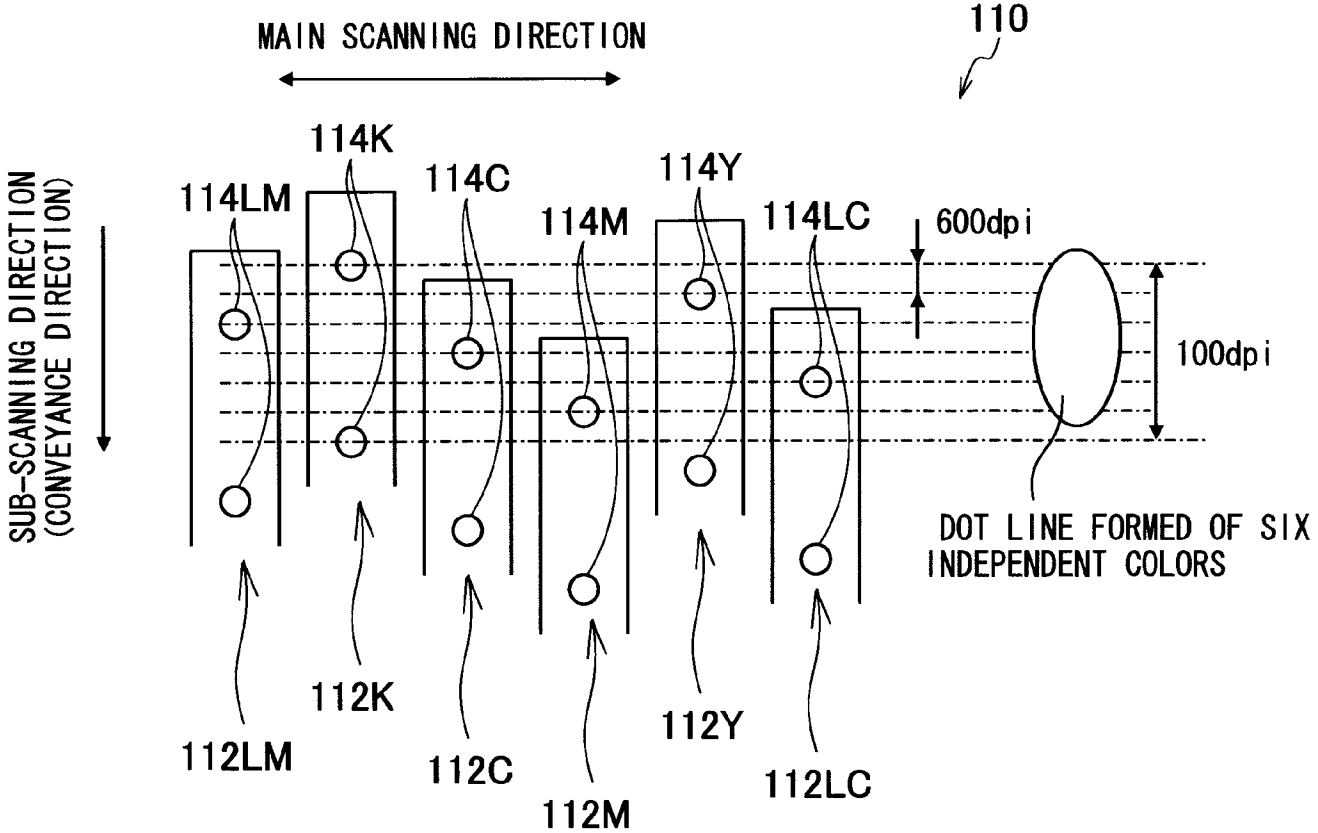
FIG. 3 is an enlarged schematic view of an inkjet head.

FIG. 3 is an enlarged schematic view of the inkjet head 110. The inkjet head 110 includes six heads 112K, 112C, 112M, 112Y, 112LC, and 112LM (one example of nozzle rows). These respective six heads 112K, 112C, 112M, 112Y, 112LC, and 112LM have a plurality of nozzles 114K, 114C, 114M, 114Y, 114LC, and 114LM each for ejecting a black ink (K ink), a cyan ink (C ink), a magenta ink (M ink), a yellow ink (Y ink), a light cyan ink (LC ink), and a light magenta ink (LM ink) which are ultraviolet curable inks (one example of UV curing inks, curable inks cured by imparted activation energy). Here, the LC ink is an ink (light ink) having a color tone similar to that of the C ink but has a colorant concentration lower than that of the C ink. Similarly, the LM ink is an ink (light ink) having a color tone similar to that of the M ink but has a colorant concentration lower than that of the M ink.

Out of the inks of six colors including the K ink, the C ink, the M ink, the Y ink, the LC ink, and the LM ink, the K ink has the lowest cure sensitivity with respect to a wavelength (e.g., 385 nm) of ultraviolet light emitted from the curing light sources 116R and 116L, and the Y ink has the second lowest cure sensitivity. Thereafter, the cure sensitivity is lowered in order of the LM ink, the C ink, the LC ink, and the M ink.

The cure sensitivity herein refers to an amount of energy necessary for completely curing an ink droplet, which is to be cured through irradiation with ultraviolet light. The cure sensitivity is higher as the necessary energy amount is smaller. Therefore, the phrase "having the lowest cure sensitivity" indicates that a large amount of energy is necessary to completely cure the ink droplet.

A plurality of the nozzles 114K in the head 112K are arranged in one row at regular intervals along the sub-scanning direction. Similarly, a plurality of the nozzles 114C in the head 112C, a plurality of the nozzles 114M in the head 112M, a plurality of the nozzles 114Y in the head 112Y, a plurality of the nozzles 114LC in the head 112LC, and a plurality of the nozzles 114LM in the head 112LM are each arranged in one row at regular intervals along the sub-scanning direction. In this case, pitches of the nozzles 114 in the heads 112 of the respective colors are all set at 100 dpi.

The heads 112 of the respective colors are arranged in order of 112LM, 112K, 112C, 112M, 112Y, and 112LC from the left side in the main scanning direction.

In terms of the sub-scanning direction, the nozzle 114K is arranged on the most upstream side in a recording medium conveyance direction. The heads 112 of the respective colors are arranged out of alignment with each other so that the nozzles are arrayed at regular intervals (at intervals of 600 dpi (254 μm/6=about 42 μm)) in order of 114K, 114Y, 114LM, 114C, 114LC, and 114M toward the downstream side. In this case, a nozzle (invalid nozzle) not for use in printing may be disposed on the side more upstream than the nozzle 114K as long as the nozzle 114K is the nozzle disposed on the most upstream side among the nozzles (valid nozzles) for use in printing.

Thus, the heads 112 of the respective colors are arranged so as to be shifted by P/N from each other in the sub-scanning direction, where P designates a nozzle pitch and N designates the number of heads (the number of nozzle rows). It is to be noted that the phrase "being shifted in the sub-scanning direction" indicates the state in which the nozzles (first nozzles) on the most upstream side in the recording medium conveyance direction, among the nozzles 114 in the respective color heads 112, are disposed in front of or in rear of the first nozzle of a reference ink. The first nozzles refer not only to those on the most upstream side in the recording medium conveyance direction among a plurality of the nozzles 114 provided in the respective color heads 112 but refer to the nozzles on the most upstream side among those that are used for ejection in a pertinent image formation mode and contribute to image formation.

The inkjet head 110 is made to perform reciprocal scanning in the main scanning direction by a scanning action performed by the carriage 118, and also ejects inks from the nozzles 114 in the respective color heads 112 under the control of the control unit 138, so that ink droplets of respective color inks are deposited on a recording surface of the recording medium 120.

Whenever the inkjet head 110 is made to scan in the main scanning direction, the recording medium 120 is conveyed (scanned) by the recording medium conveying mechanism 132 by a specified amount in the sub-scanning direction. In this specification, the upper side of FIG. 1 is referred to as the upstream side in the conveyance direction of the recording medium 120, while the lower side of FIG. 1 is referred to as the downstream side in the conveyance direction of the recording medium 120.

The curing light sources 116R and 116L (one example of an activation energy imparting device) respectively include a plurality of UV-LEDs. The curing light sources 116R and 116L are controlled by the control unit 138 so that the UV-LEDs positioned on the upstream side of the carriage 118 in the main scanning direction are turned off and the UV-LEDs positioned on the downstream side are turned on. The turned-on UV-LEDs irradiate ink droplets of the respective color inks, which are ejected from the respective color heads 112 and deposited on the recording medium 120, with ultraviolet light to imperfectly cure (semi-cure) the ink droplets.

More specifically, when inks are ejected from the nozzles 114 in the respective color heads 112 while the carriage 118 moves rightward in FIG. 1, the UV-LEDs of the curing light source 116L positioned on the downstream side in the scanning direction irradiate the ink droplets with ultraviolet light. When inks are ejected from the nozzles 114 in the respective color heads 112 while the carriage 118 moves leftward in FIG. 1, the UV-LEDs of the curing light source 116R positioned on the downstream side in the scanning direction irradiate the ink droplets with ultraviolet light.

Ink droplets deposited on the recording medium 120 are not completely cured by one ultraviolet irradiation from the curing light sources 116R and 116L and are put in a semi-cured state. The semi-cured state herein refers to the state of the inks after start of curing and before completion of curing. The ink droplets in the semi-cured state are put in a completely cured state by receiving further ultraviolet light irradiation from an unshown main curing light source disposed on the downstream side in the conveyance direction of the recording medium 120. As a consequence, an image is recorded on the recording surface of the recording medium 120. Note that the term "completely cured state" is used to refer to the state of ink droplets which are cured to an extent whereby an image is not deteriorated even when handling of the recording medium 120 is carried out. In other words, the complete curing does not necessarily mean that a curing reaction is completed. In the present embodiment, the main curing light source may be a light source mounted on the inkjet head (refer FIG. 13 explained later), but it also may be a light source provided separately/independently from the inkjet head. In the latter case, single light source width of which is substantially equal to the width of the recording medium can be used, but a plurality of light sources each of which has width shorter than the width of the recording medium can also be used.

It is to be noted that an amount of irradiation light from the curing light sources 116R and 116L and an amount of irradiation light from the main curing light source can separately be set. As mentioned before, the glossiness of a recorded image can be increased by reducing the amount of irradiation light at the time of semi-curing.

[Method for Image Formation by Inkjet Recording Apparatus]

Figure 4:
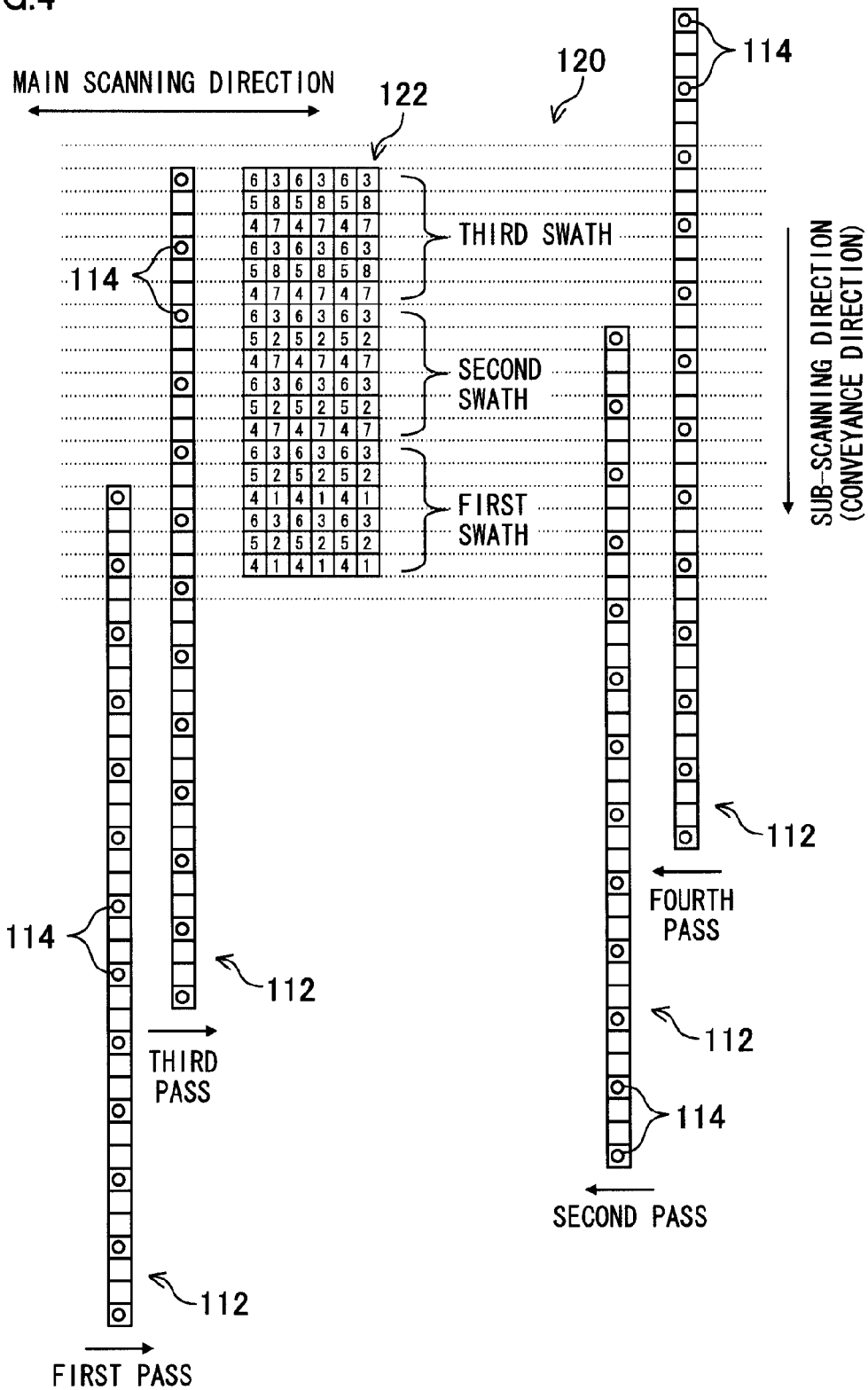
FIG. 4 is a view for explaining an interlace method.

FIG. 4 is a view for explaining an interlace method (a method for ejecting ink droplets in a specified region with a plurality of passes) which is a method for image formation of the inkjet recording apparatus 100. In the inkjet recording apparatus 100, the control unit 138 controls each of the inkjet head 110, the curing light sources 116R and 116L, the carriage scanning mechanism 130, and the recording medium conveying mechanism 132, so that image formation can be carried out according to the interlace method. A description is herein given of an example where printing is performed by total six passes including two passes in the main scanning direction and three passes in the sub-scanning direction.

Reference numeral 122 shown in FIG. 4 designates a recording position (a pixel group) on the recording surface of the recording medium 120 at which ink droplets should be deposited. A digit in each pixel shows the number of passes with which an ink droplet is deposited on the pixel.

First, the inkjet head 110 is made to scan rightward in the main scanning direction by the carriage scanning mechanism 130 (first pass). At this time, inks are ejected from the respective nozzles 114 of the respective color heads 112 and ink droplets of the respective colors are deposited at the positions of "1" in the pixel group 122. That is, in the first pass, droplets are deposited on each even row among sub-scanning rows in the pixel groups 122. As shown in FIG. 3, the respective nozzles 114 in the respective color heads 112 are arranged so as to be shifted by 600 dpi from each other, and therefore the deposited ink droplets form a line of independent dots of six colors in the range of 100 dpi.

During the first-pass scanning, the curing light source 116L irradiates the ink droplets of the respective colors deposited on the recording surface of the recording medium 120 with ultraviolet light. As a consequence, the ink droplets of the respective colors are put in a semi-cured state.

Once the first-pass main scanning is finished, the recording medium 120 is conveyed by a specified amount in the sub-scanning direction (downward in FIG. 4) by the recording medium conveying mechanism 132. FIG. 4 shows the inkjet head 110 displaced by a specified amount to the upper side of FIG. 4 for the sake of explanation.

Next, the inkjet head 110 is made to scan leftward in the main scanning direction (second pass). At this time, inks are ejected from the respective nozzles 114 of the respective color heads 112, and ink droplets of the respective colors are deposited at the positions of "2" in the pixel group 122. That is, in the second pass, droplets are deposited on pixels which belong to each even row among the sub-scanning rows and which are adjacent (adjacent on the upstream side in the recording medium conveyance direction) to main scanning rows of the pixels subjected to deposition in the first pass (the pixels at the positions of "1" in the pixel group 122). As in the case of the first pass, a line of independent dots of six colors is formed in the range of 100 dpi.

During the second-pass scanning, the curing light source 116R irradiates the ink droplets of the respective colors deposited on the recording surface of the recording medium 120 with ultraviolet light. As a consequence, the ink droplets of the respective colors deposited during the second pass are put in a semi-cured state. At the same time, the ink droplets deposited during the first pass are also irradiated with ultraviolet light, by which their curing is promoted.

Once the second-pass main scanning is finished, the recording medium 120 is conveyed by a specified amount in the sub-scanning direction.

Further, the inkjet head 110 is made to scan rightward in the main scanning direction (third pass). At this time, inks are ejected from the respective nozzles 114 of the respective color heads 112, and droplets are deposited at the positions of "3" in the pixel group 122. That is, in the third pass, droplets are deposited on pixels which belong to each even row among the sub-scanning rows and which are adjacent (adjacent on the upstream side in the recording medium conveyance direction) to main scanning rows of the pixels subjected to deposition in the second pass (the pixels at the positions of "2" in the pixel group 122). The curing light source 116L also irradiates the ink droplets deposited during the third pass with ultraviolet light so as to put the ink droplets in a semi-cured state.

Sub-scanning and main scanning are then repeated in the similar manner, so that droplets are deposited at the positions of "4", "5", and "6" in the pixel group 122. More specifically, droplets are sequentially deposited on each odd row among the sub-scanning rows.

Thus, ink droplets are deposited on all the pixels of a first swath by the first to sixth passes. Similarly, ink droplets are deposited on all the pixels of a second swath by the second to seventh passes, and ink droplets are deposited on all the pixels of a third swath by the third to eighth passes.

Here, since the heads 112 of the respective colors are arranged in order of 112K, 112Y, 112LM, 112C, 112LC, and 112M in the sub-scanning direction, the K ink with the lowest cure sensitivity is deposited on the surface of the recording medium 120 first, and the Y ink with the second lowest cure sensitivity is deposited next. Thereafter, landing of inks occurs in ascending order of cure sensitivity, that is, in order of the LM ink, the C ink, the LC ink, and the M ink. Therefore, the K ink, the Y ink, the LM ink, the C ink, the LC ink, and the M ink are laid on the recording medium surface in this order toward an upper layer thereof.

Figures 5, 6A, 6B, 6C:
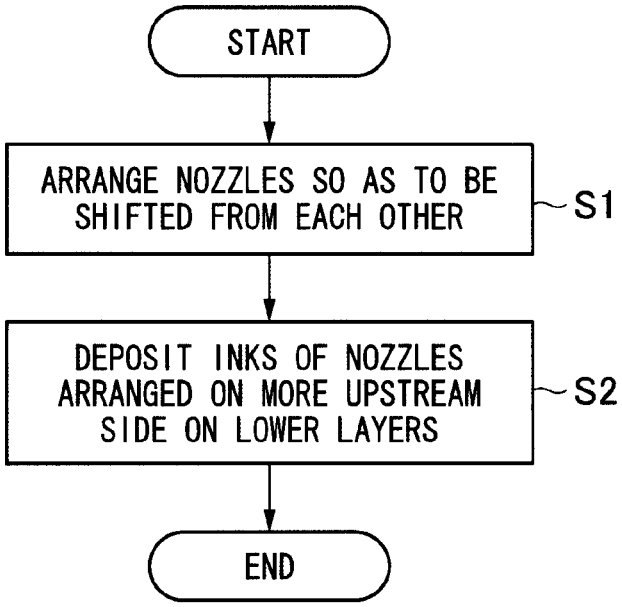
FIG. 5 is a flow chart showing a method for image formation in the present embodiment.
FIG. 6A to 6C are views showing another droplet deposition order in the interlace method.

Thus, in the present embodiment, the nozzles are arranged so as to be shifted in ascending order of cure sensitivity (Step S1 of FIG. 5), so that the inks with lower cure sensitivity are laid on lower layers while the inks with higher cure sensitivity are laid on upper layers (the inks of the nozzles arranged on the more upstream side in the recording medium conveyance direction are laid on lower layers) to carry out image formation (Step S2 of FIG. 5). Accordingly, the surface layer can constantly be kept in a stable state and uneven glossiness can be reduced.

Furthermore, UV curing inks do not permeate into a recording medium at the time of curing but form three-dimensional shapes on the surface of the recording medium. Accordingly, in a black solid image made up of 4C colors (the cyan ink, magenta ink, yellow ink, black ink) that require a large amount of inks to be ejected, uneven glossiness becomes notable. In a high-density image portion made up of the inks of these four types, light inks are hardly used.

Therefore, in the present embodiment, the heads 112 of the respective colors in the sub-scanning direction are arranged so that a nozzle of light ink is placed in between the nozzles of thick inks including the Y ink, the C ink, and the M ink. Such an arrangement makes it possible to reduce droplet ejection interference between thick inks and to thereby avoid uneven glossiness.

In this nozzle order in the sub-scanning direction, the nozzles 114 of the respective colors are arranged at intervals of 600 dpi in the range of 100 dpi that is an interval of the nozzles 114 in the respective color heads 112. Accordingly, in the inkjet recording apparatus having the light source separated into a light source for semi-curing and a light source for main curing, illuminance of the semi-curing light source can be reduced so that an image having high glossiness and less noticeable uneven glossiness can be formed.

Thus, in consideration of cure sensitivity of inks, positions of the respective color heads 112 in the sub-scanning direction are shifted so that nozzles of the inks with lower sensitivity are positioned on the more upstream side in the recording medium conveyance direction, and the nozzle of the light ink is placed in between the nozzles of thick inks so that a space is formed between dots of thick inks at the time of forming a high-density image. As a result, it becomes possible to further reduce a light amount of the semi-curing light source, and to achieve both the increase in glossiness and the avoidance of uneven glossiness at the same time.

Although inks of two colors, the LC ink and the LM ink, are used as the light ink in the present embodiment, the light ink is not limited to two colors. A light black ink (LK ink) which is similar in color tone to the K ink but has a colorant concentration lower than that of the K ink, and a light yellow ink (LY ink) which is similar in color tone to the Y ink but has a colorant concentration lower than that of the Y ink may be used to constitute a 1 to 4 color configuration. In this case, the heads 112 of the respective colors in the sub-scanning direction are arranged such that the nozzle of light ink is placed in between the nozzles of thick inks including the K ink, the Y ink, the C ink, and the M ink, so that droplet ejection interference between thick inks can be reduced.

In the present embodiment, a description has been given of an example where images are formed according to the interlace method involving six passes as explained with reference to FIG. 4. However, the number of passes and the order of droplet deposition are not limited to the configuration disclosed. For example, as in the case of droplet deposition order shown in FIGS. 6A to 6C, printing may be carried out with total ten passes including two passes in the main scanning direction and five passes in the sub-scanning direction, and other printing methods such as an interlace printing with 8 passes may also be implemented.

In the present embodiment, the positions of the respective color heads 112 in the sub-scanning direction are shifted so that the nozzles of the inks with lower sensitivity are positioned on the more upstream side in the recording medium conveyance direction. However, if the nozzle of the ink with the lowest cure sensitivity is arranged on the most upstream side, and the ink with the lowest cure sensitivity is laid on a layer closest to the recording medium, an effect of avoiding uneven glossiness can be obtained to some extent even though other inks are arranged in different order.

For example, in the case of the ink set of the present embodiment, the nozzle 114K of the ink with the lowest cure sensitivity is arranged on the most upstream side in the conveyance direction of the recording medium 120, so that the K ink is deposited on the surface of the recording medium 120 first (i.e., the K ink is deposited on the layer closest to the recording surface of the recording medium 120). Other nozzles may be arranged in order of 114K, 114C, 114LM, 114M, 114LC and 114Y, or in order of 114K, 114M, 114LC, 114Y, 114LM, and 114C toward the downstream side.

[Data Processing Method]

Since the positions (of the nozzles 114) of the respective color heads 112 are arranged to be shifted in the sub-scanning direction as shown in FIG. 3, half tone image data is processed so that a halftone data portion at a shifted position is cut off in every raster and transferred to the heads 112 of the respective colors, where droplets of the halftone data are ejected.

Halftoned image data is generated on RIP software in the same way as other data, and is inputted into the inkjet recording apparatus 100 via the image input interface 134, before being sent to the image processing unit 136. The data sent to and stored in the image processing unit 136 is in the form of a sequence of dots of the respective colors, such as LM, K, C, M, Y, and LC colors, which are obtained by shifting image data by one dot from an upper end of the image in the sub-scanning direction.

In the image processing unit 136, in accordance with a shift amount of the head 112 of each color, image data from a point, which is shifted from given color data used as a reference by an amount close to the shift amount in the sub-scanning direction, is sent to the control unit 138. In accordance with the shifted arrangement, data from the point which is shifted from the reference color data in the sub-scanning direction is transferred to the control unit 138. Consequently, while a general halftone process is executed on the RIP software, the inkjet recording apparatus 100 side performs output corresponding to the shifted positions of the respective color heads 112, which makes it possible to execute image formation processing which produces a complete image that is not very affected by the arrangement of the heads 112 of the respective colors being shifted.

Although the present embodiment is configured so that the halftoned image data is inputted from the image input interface 134, it is possible to adopt the configured in which RGB image and the like are inputted and converted into dot data for printing in the image processing unit 136.

EXAMPLES

Relative Comparison in Cure Sensitivity Between Inks of the Respective Colors Relative comparison of cure sensitivity between respective colors of UV curing ink by Fuji Specialty Ink System Co., Ltd. was conducted with an ink sensitivity evaluation apparatus.

The ink sensitivity evaluation apparatus extracts a sample of UV curing ink with a micropipette, and spreads the sample in a gap (15 μm) between a slide glass and a glass plate of 10 mm×10 mm. The ink sample is irradiated with UV light having a wavelength of 380 mm, which is generally close to the wavelength of UV light actually used for curing, and a half-value width of 10 nm, through the glass substrates so as to be cured. Relative evaluation of the cure sensitivity can be implemented by measuring a period of time taken for curing in every ink color.

Whether the ink sample was cured or not was evaluated by pressing the upper glass substrate from the side to apply shearing force thereto while the lower slide glass substrate was put in a fixed state. More specifically, the ink sample was continuously exposed to UV light of constant illuminance (about 50 [mW/cm$^2$]), and the glass substrates were pressed and pulled by using a voice coil motor so as to convert the shearing force from the side into reciprocating actions. The state where the glass substrates were not shifted nor moved by the pressing and pulling action by the voice coil motor was defined as a cured state. By setting irradiation time taken for curing as exposure time, the cure sensitivity of every ink color was relatively compared with precision.

Figure 7:
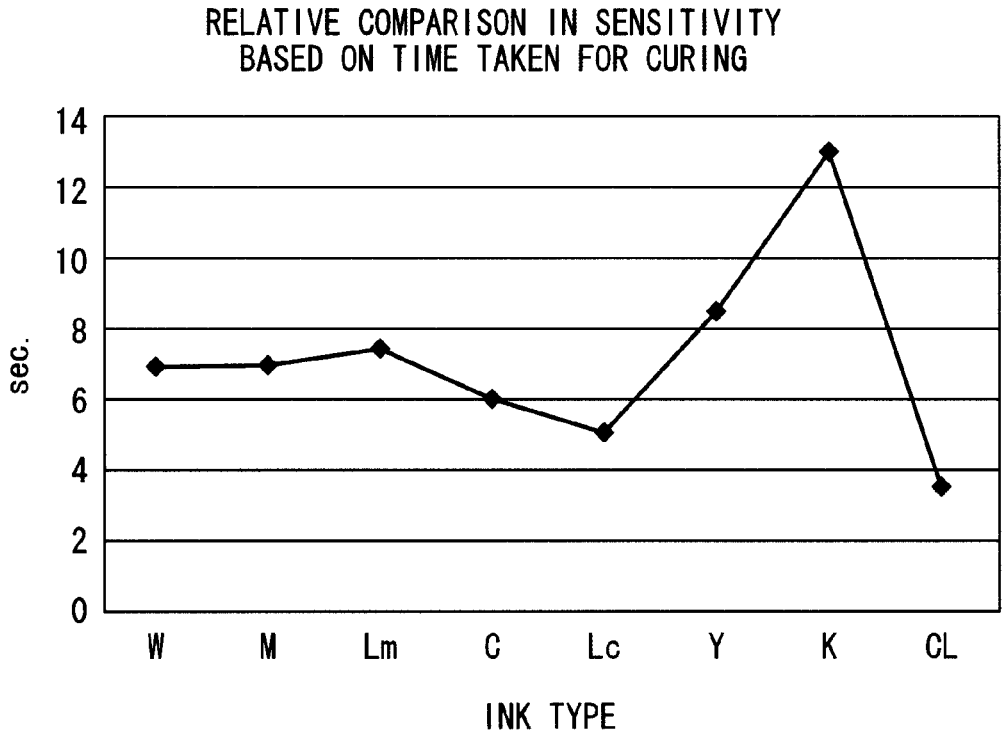
FIG. 7 is a view showing an evaluation result of cure sensitivity in every ink color.

A result of the evaluation is shown in FIG. 7. In FIG. 7, a horizontal axis represents an ink kind (ink color) while a vertical axis represents irradiation time until the glass substrates are not shifted nor moved. A period of time, taken for continuously exposing each ink sample to UV light of constant illuminance to the extent whereby each sample was no longer moved by shearing stress, was proportional to an exposure value [mJ/cm$^2$].

As shown in FIG. 7, the ink that took the longest time for curing was the K ink, whose irradiation time, from the start of irradiation to the time when the glass substrates ceased to move, was 13 seconds. The ink that took the second longest time for curing was the Y ink whose irradiation time was 8.5 seconds.

In other words, it was found out that the K ink had the lowest cure sensitivity among the inks of the respective colors and that the Y ink had the second lowest cure sensitivity among the inks of the respective colors.

[Head Arrangement]

A wide format printer was prepared by filling and mounting UV curing inks by Fuji Specialty Ink System Co., Ltd. into Acuity LED1600 Printer by Fuji Photo Film Co., Ltd. Acuity LED1600 Printer can separately set the light amounts of UV irradiation light sources for pinning (semi-curing) and for curing (main curing), so that a reduced pinning light amount can be set to increase gloss feeling.

Furthermore, based on the evaluation result shown in FIG. 7 and in consideration of a difference in sensitivity between respective color inks, positions of respective color heads of Acuity LED1600 Printer in the sub-scanning direction were determined.

Figure 8A:
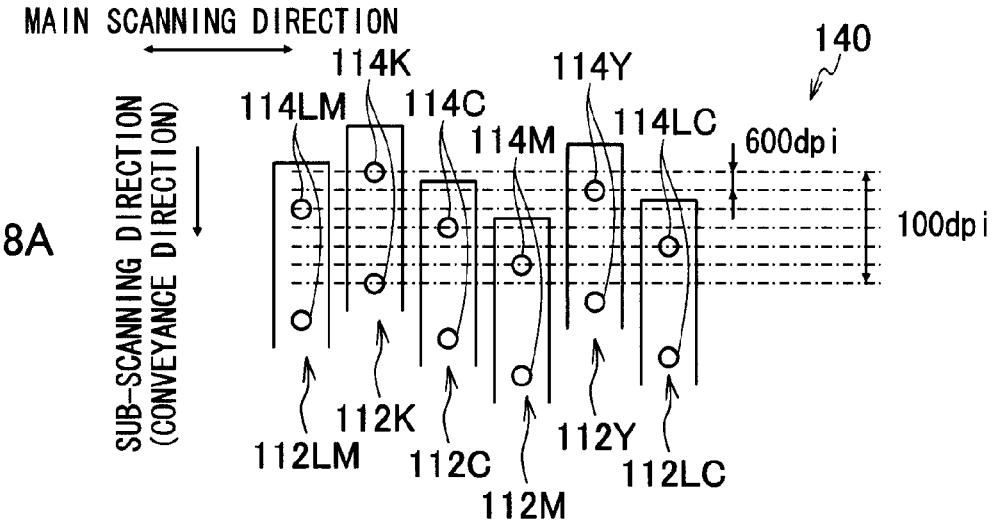
FIGS. 8A to 8C are views showing head units in examples.

FIG. 8A is a schematic view showing a head unit 140 of Acuity LED1600 Printer, in which respective color heads and nozzles are designated by reference characters identical to those of the inkjet head 110 shown in FIG. 3. In Acuity LED1600 Printer, QE-10 heads by Dimatix Co., Ltd. is used as the heads 112 of the respective colors. The QE-10 head has a nozzle pitch of 100 dpi.

As shown in FIG. 8A, in the head unit 140, the heads 112 of the respective colors were arranged in order of 112LM, 112K, 112C, 112M and 112Y, and 112LC from the left-hand side as viewed from the front in the main scanning direction. In the sub-scanning direction, the heads 112 were arranged in order of 112K, 112Y, 112LM, 112C, 112LC, and 112M from upstream to downstream in the recording medium conveyance direction. Although not shown in the drawing, a white ink (W ink) head and a clear ink (CL ink) head were respectively arranged on both sides in the main scanning direction.

Since these respective six heads 112K, 112Y, 112LM, 112C, 112LC and 112M, had nozzle intervals of 100 dpi (about 254 μm), the heads were arranged so as to be shifted in the sub-scanning direction at intervals of 600 dpi (about 42 μm) which were expected to cause ejected inks of the respective colors to be spread in a most uniform manner and to be less likely to be laid on top of each other. More specifically, since the nozzle pitch was P=254 μm and the number of heads was N=6, the heads were arranged so as to be shifted by P/N=42 μm from each other in the sub-scanning direction. Since the W ink and the CL ink do not contribute to uneven density, these heads are not counted as the number of heads N. The nozzle positions in the sub-scanning direction may suitably be determined.

Figure 8B:
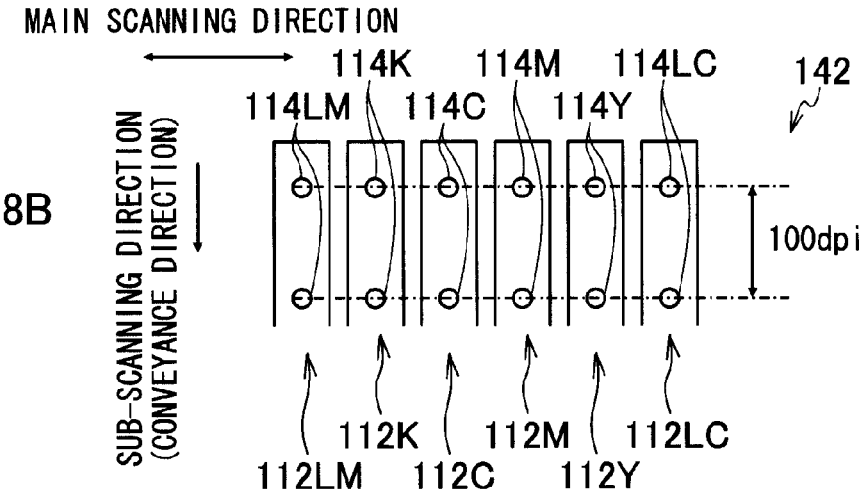
Figure 8C:
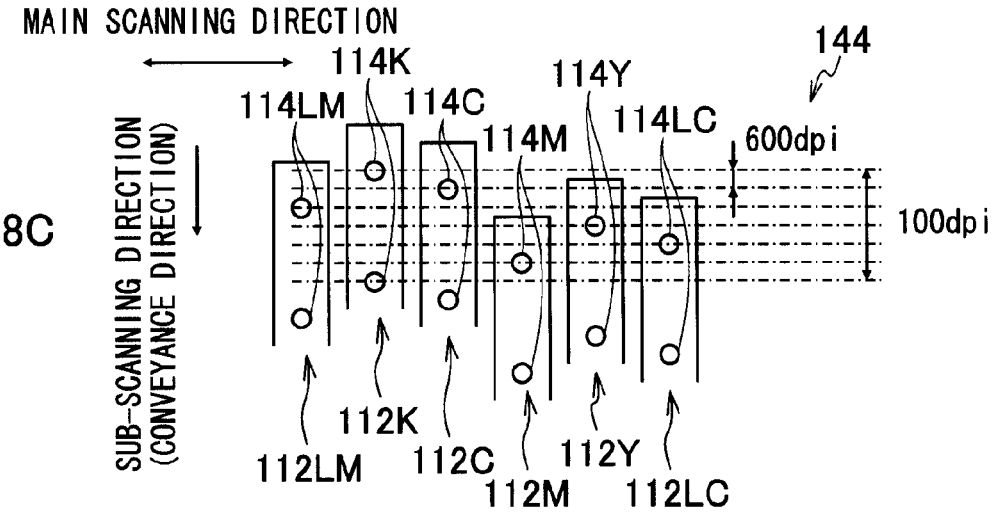

In order to compare occurrence of uneven glossiness, there were prepared a head unit 142 configured to have all the fixed positions of the respective color heads 112 being arranged to be identical in the sub-scanning direction as shown in FIG. 8B, and a head unit 144 configured to have the fixed positions of the respective color heads 112 being arranged so as to be shifted from each other in order of 112K, 112C, 112LM, 112Y, 112LC, and 112M from upstream to downstream in the recording medium conveyance direction as shown in FIG. 8C.

Each of these three kinds of head units 140, 142, and 144 were each made to output an image, and how a glossiness value of each output image distributed in the sub-scanning direction was evaluated.

The image was outputted in a droplet ejection order shown in FIG. 6A, so that inks of the nozzles arranged on the more upstream side in the recording medium conveyance direction were laid on lower layers (on layers closer to the recording medium).

As an image for use in evaluation, a black solid image was used which was considered to have most noticeable uneven glossiness as the black solid image was formed with all inks of four colors laid on top of each other. More specifically, a black (4C) solid image made up of four colors by the C ink (gradation command value of 75%), the M ink (gradation command value of 68%), the Y ink (gradation command value of 67%), and the K ink (gradation command value of 90%) was printed under the condition of 600 dpi main scanning×500 dpi sub-scanning and a swath width of about 6.4 mm.

The uneven glossiness is herein used to refer to a phenomenon of the glossiness losing uniformity and being visually recognized with periodic unevenness because the glossiness of an image is varied depending on viewing direction due to UV curing inks being cured without losing their three-dimensional forms.

Figure 9:
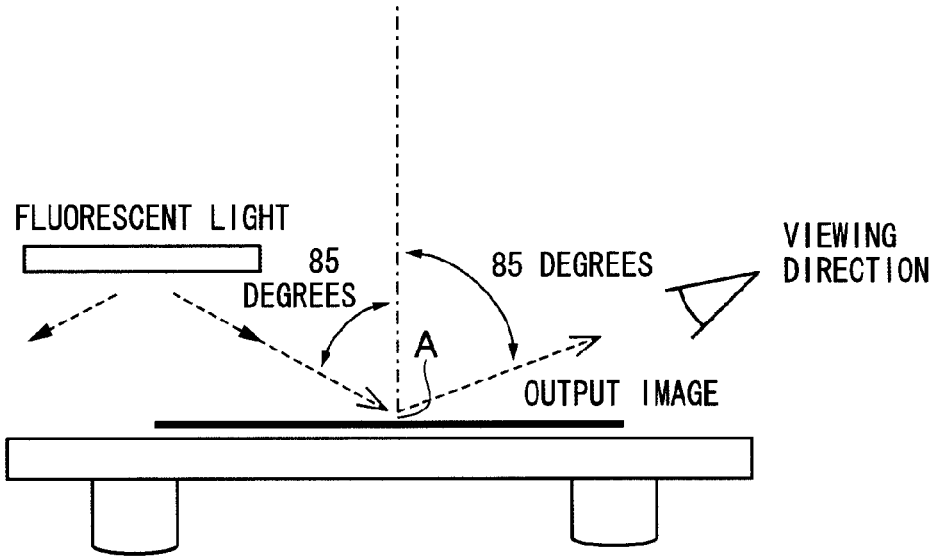
FIG. 9 is a view explaining uneven glossiness.

The observed unevenness is particularly significant when an image is placed under a linear light source such as a fluorescent light and is visually observed in the direction of mirror reflection of a length direction of the linear light source. For example, in an example shown in FIG. 9, uneven glossiness at a point A on an image has an angle of 85 degrees formed between a light beam from the fluorescent light and a perpendicular line at the point A. Consequently, the observed uneven glossiness is particularly significant at a position of 85 degrees which is symmetric with the light beam from the fluorescent light with respect to the perpendicular line at the point A.

Solid images outputted by these three types of head units 140, 142, and 144 were measured at intervals of about 2 mm in the main scanning direction with use of a glossmeter (Micro Tri Gloss) by BYK Co., Ltd.

As a result, a width between a maximum value and a minimum value of glossiness value distribution in each head unit was Δ 1.56 in the head unit 140, Δ 1.67 in the head unit 142, and Δ 1.62 in the head unit 144. That is, the uneven glossiness was larger in order of the head units 142, 144, and 140.

Thus, in shuttle-scanning UV printing for image formation through main scanning and sub-scanning actions, image formation was carried out by arranging nozzles of the respective heads to be shifted by P/N from each other in the sub-scanning direction, where P designated a nozzle pitch and N designated the number of heads, arranging the nozzle of the ink with the lowest cure sensitivity on the most upstream side in the recording medium conveyance direction, and by further arranging the nozzles of light inks in between the nozzles of thick inks, so that inks ejected from the nozzles arranged on the more upstream side in the recording medium conveyance direction were laid on lower layers. As a result, it was found out that uneven glossiness could be reduced since the ink with the lowest cure sensitivity was laid on the layer closest to the recording surface and landing interference between the thick inks was reduced thereby.

It was also found out that uneven glossiness could be further reduced by arranging the nozzle of the ink with the second lowest cure sensitivity on the second most upstream side of the recording medium, so that the ink with the lowest cure sensitivity could be laid on the layer closest to the recording surface, and the ink with the second lowest cure sensitivity could be laid on the layer second closest to the recording surface.

It was confirmed that even if a light amount approximately half the normal light amount was set as the light amount of the semi-curing light source in the above case, considerable deterioration in resolution, due to color mixture by landing interference, did not occur.

When the heads 112 of the respective colors are not shifted in the sub-scanning direction as in the case of the head unit 142, UV curing inks are laid on top of each other in the main scanning direction and form a parallel line, while droplet ejection interference and combining of dots progress in the sub-scanning direction. As a consequence, droplet deposited positions were separated at nozzle intervals, which causes a tendency of distance between adjacent dots being increased. As a result, a glossiness value in the main scanning direction becomes higher as the three-dimensional shapes formed by the UV curing inks have an identical height, whereas a glossiness value in the sub-scanning direction becomes lower with larger depressions and projections being formed.

As a result, it was found out that a finally obtained image had glossiness values different in the main scanning direction and in the sub-scanning direction. It was found out that an image poor in surface smoothness was formed as the UV curing inks formed peaks and valleys at intervals of 100 dpi, which caused image quality degradation.

Contrary to the above, according to the head unit 140, the heads 112 of the respective colors were arranged in the sub-scanning direction in order of 112K, 112Y, 112LM, 112C, 112LC, and 112M. Accordingly, the K ink with the lowest cure sensitivity was deposited on the recording medium first, and the Y ink with the second lowest cure sensitivity was deposited next.

Although the thick inks including the Y ink, the C ink, and the M ink were respectively ejected up to a high density section, the light inks including the LM ink and the LC ink were low in a rate of high density droplet ejection.

Since it was desirable to reduce landing interference of thick inks as much as possible, the respective color heads 112 were arranged so that the LM ink and the LC ink, which were light inks, were ejected between the Y ink, the C ink, and the M ink which were thick inks.

As a result, the arrangement of the nozzle heads in the sub-scanning direction was is in order of 112K, 112Y, 112LM, 112C, 112LC, and 112M toward the downstream in the sub-scanning direction, so that the inks with lower cure sensitivity were laid on lower layers and the inks with higher cure sensitivity were deposited on upper layers to carry out image formation.

Such arrangement of the respective color heads causes the inks with high sensitivity to be deposited on upper layers, so that the inks are cured while leaving three-dimensional shapes which resemble with each other at a high probability.

Contrary to this, if the inks with low sensitivity are arranged to be deposited on the uppermost layers, the inks have high probability of flowing to top or side sections of the peaks and valleys made by a base ink and be cured in that state at the time of forming three-dimensional shapes. As a result, final three-dimensional shapes become uneven.

This phenomenon becomes the most notable when an ink with low sensitivity is configured to be deposited over an ink with high sensitivity with the heads thereof are not shifted from but aligned with each other in the sub-scanning direction, and the uneven glossiness is expected to be notable at an interval (in the swath width) of every scanning action performed in the direction from the right side to the left side (outward trip) and from the left side to the right side (return trip).

[Reduction of Uneven Glossiness in Secondary Color]

An input image made of 100% secondary color R using the M ink and the Y ink was outputted, and a relation between a visual evaluation of uneven glossiness and an amount of shift between two color nozzles was evaluated. An image used for evaluation was printed by bidirectional printing under the condition of 600 dpi main scanning×500 dpi sub-scanning, a large droplet dot diameter of 95 μm, and 2 main scanning passes×5 sub-scanning passes.

Figure 10:
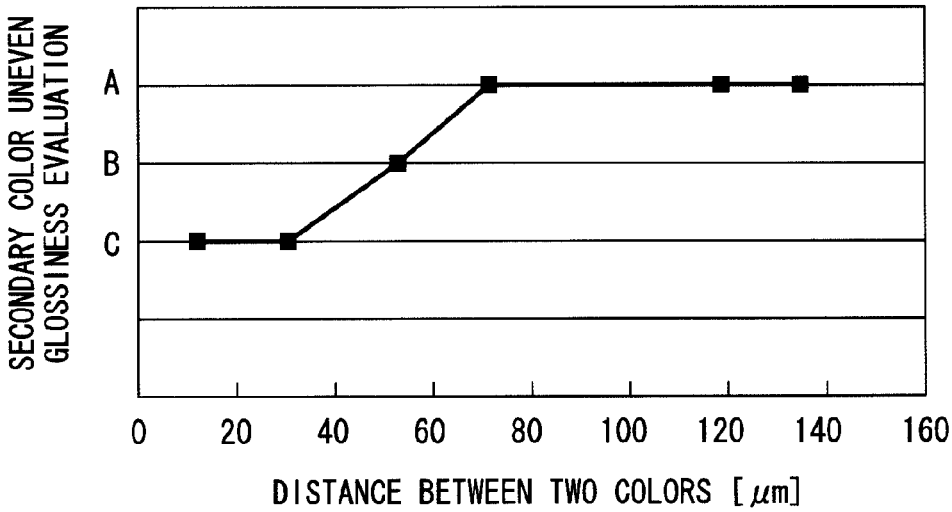
FIG. 10 is a view showing a relation between a visual evaluation of uneven glossiness and an amount of shift between two color nozzles.

A result of the evaluation is shown in FIG. 10. In FIG. 10, visually unrecognizable uneven glossiness was evaluated as "A", visually recognizable slight uneven glossiness was evaluated as "B" and visually recognizable clear uneven glossiness was evaluated as "C".

As shown in FIG. 10, it was found out that shifting the heads by ½ (47.5 μm) of the dot diameter (95 μm) or more produces a notable effect of improving the unevenness.

Thus, if the shift amount is small, the shift effect is diminished due to landing interference. Therefore, by distancing the nozzles by ½ of the dot diameter or more to suppress combining of two dots, the effect of improving uneven glossiness can be enhanced.

In the case of the head unit 140 shown in FIG. 8A, the heads 112 of the respective colors are arranged so that the LM ink and the LC ink which are light inks are ejected between the Y ink, the C ink, and the M ink which are thick inks. Therefore, since a distance between dots of thick inks is about 84 μm, which is more than ½ (47.5 μm) of the dot diameter, uneven glossiness can be improved.

Another Embodiment

[General Composition of Inkjet Recording Apparatus]

Figure 11:
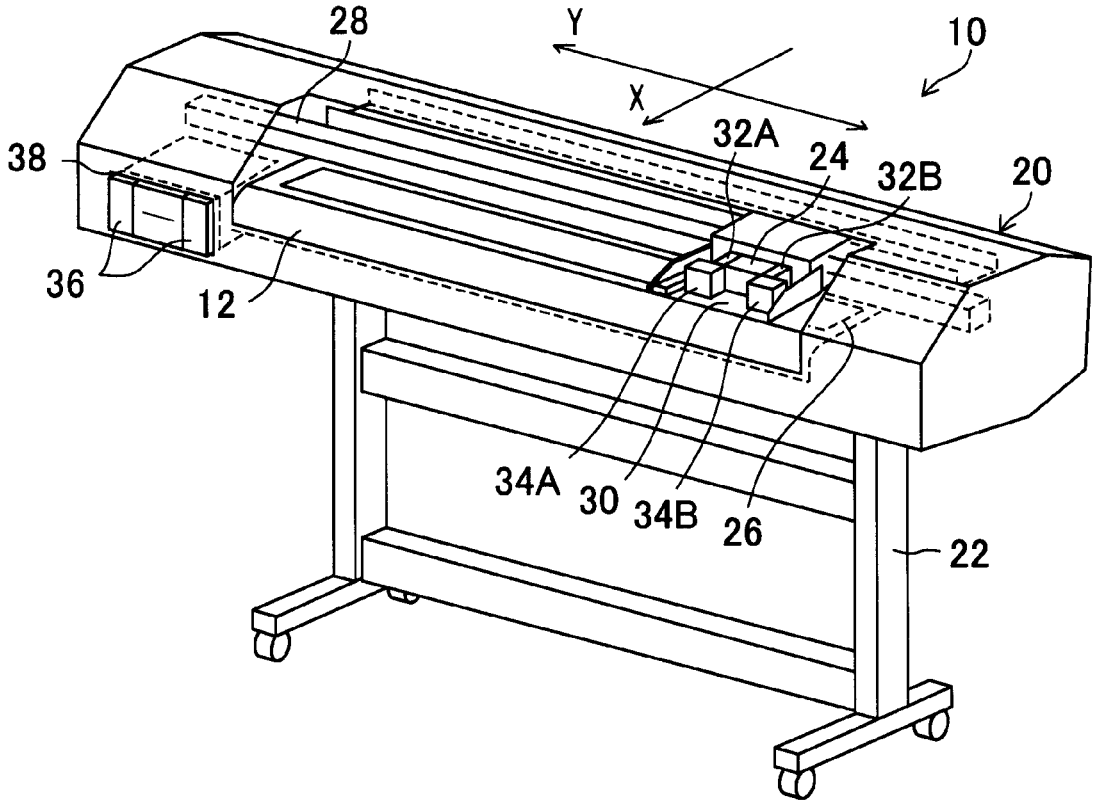
FIG. 11 is a general perspective view of an inkjet recording apparatus according to another embodiment.

FIG. 11 is a general perspective view of an inkjet recording apparatus according to another embodiment. The inkjet recording apparatus 10 is a wide-format printer which forms a color image on a recording medium 12 by using ultraviolet (UV) curable inks (UV curing inks). The wide-format printer is an apparatus suitable for performing recording in a wide image formation range, such as for large posters or commercial wall advertisements, or the like. Here, a printer corresponding to a medium having a size of A3+ or greater is referred to as the "wide-format printer".

The inkjet recording apparatus 10 has a main body 20 and a stand 22, which supports the main body 20. The main body 20 contains: a drop-on-demand type of inkjet head 24 which ejects the inks onto the recording medium (medium) 12; a platen 26, which supports the recording medium 12; and a guide mechanism 28 and a carriage 30 (one example of a scanning device), which form a head movement device.

The guide mechanism 28 is disposed so as to extend above the platen 26, along a scanning direction (Y direction) which is parallel to the medium supporting surface of the platen 26 and perpendicular to a conveyance direction of the recording medium 12 (X direction). The carriage 30 is supported so as to be able to reciprocally move along the Y direction on the guide mechanism 28. The inkjet head 24 is mounted on the carriage 30, and provisional curing light sources 32A and 32B and main curing light sources 34A and 34B, which irradiate the inks on the recording medium 12 with UV light, are also mounted on the carriage 30.

The provisional curing light sources 32A and 32B are the light sources which irradiate the ink droplets deposited on the recording medium 12 by the inkjet head 24 with UV light for provisionally curing (semi-curing) the ink droplets to an extent whereby adjacent ink droplets do not combine together. The main curing light sources 34A and 34B are the light sources which additionally irradiate the inks after the provisional curing with UV light for completely curing the ink droplets finally (main curing).

The inkjet head 24, the provisional curing light sources 32A and 32B, and the main curing light sources 34A and 34B disposed on the carriage 30 move in unison with (together with) the carriage 30 along the guide mechanism 28.

Various medium can be used for the recording medium 12, without any restrictions on the material, such as paper, unwoven cloth, polyvinylchloride, compound chemical fibers, polyethylene, polyester, tarpaulin, or the like, or whether the medium is permeable or non-permeable. The recording medium 12 is supplied in a state of roll paper (shown in FIG. 12) from the back side of the main body 20, and after the printing, the recording medium 12 is taken up by a take-up roller 44 (not shown in FIG. 11, shown in FIG. 12) on the front side of the main body 20 (one example of a movement device). The inkjet head 24 ejects and deposits the ink droplets onto the recording medium 12 being conveyed on the platen 26, and the provisional curing light sources 32A and 32B and the main curing light sources 34A and 34B irradiate the ink droplets attached to the recording medium 12 with UV light.

An installation section 38 for ink cartridges 36 is arranged on the left-hand front side of the main body 20 in FIG. 11. The ink cartridges 36 are replaceable ink supply sources (ink tanks), which store the UV-curable inks. The ink cartridges 36 are prepared correspondingly to the inks of the respective colors which are used in the inkjet recording apparatus 10 of the present embodiment. The ink cartridges 36 of the respective colors are connected to the inkjet head 24 through ink supply channels (not shown) which are independently formed. The ink cartridges 36 are replaced when the amount of remaining ink of the corresponding color has become low.

Although not shown in the drawings, a maintenance unit for the inkjet head 24 is arranged on the right-hand front side of the main body 20. The maintenance unit includes a cap for preventing the inkjet head 24 from drying when not printing, and a wiping member (blade, web, etc.) for cleaning the nozzle surface (ink ejection surface) of the inkjet head 24. The cap covering the nozzle surface of the inkjet head 24 is provided with an ink receptacle for receiving ink droplets ejected from the nozzles for the purpose of maintenance.

[Recording Medium Conveyance Path]

Figure 12:
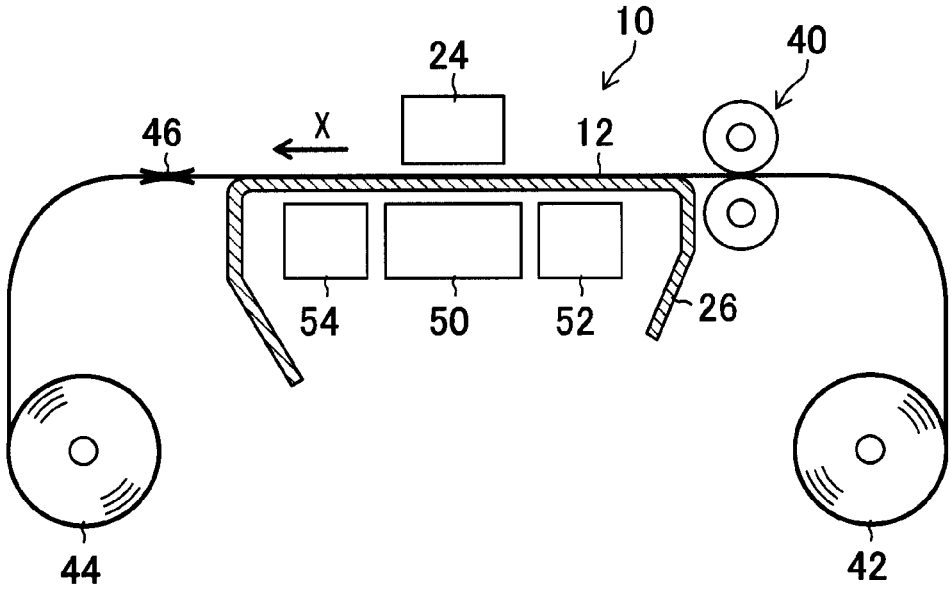
FIG. 12 is an explanatory view schematically showing a recording medium conveyance path.

FIG. 12 is an explanatory view schematically showing the recording medium conveyance path in the inkjet recording apparatus 10. As shown in FIG. 12, the platen 26 is formed in an inverted gutter shape and the upper surface thereof is a supporting surface for the recording medium 12 (which is referred to as a "medium supporting surface"). A pair of nip rollers 40 functioning as a recording medium conveyance device for intermittently conveying the recording medium 12 are arranged on the upstream side of the platen 26 in the recording medium conveyance direction (X direction), in the vicinity of the platen 26. The nip rollers 40 move the recording medium 12 in the X direction over the platen 26.

The recording medium 12 that is unwound from a supply side roll (referred to as a "pay-out supply roll") 42, which constitutes a roll-to-roll medium conveyance device, is intermittently conveyed in the X direction by the pair of nip rollers 40, which are arranged at an entrance of a print unit (on the upstream side of the platen 26 in the recording medium conveyance direction). When the recording medium 12 has arrived at the print unit directly below the inkjet head 24, printing is carried out by the inkjet head 24, and the recording medium 12 is then wound up by the roller 44 after the printing. A guide 46 for the recording medium 12 is arranged on the downstream side of the print unit in the recording medium conveyance direction.

A temperature adjustment unit 50 for adjusting the temperature of the recording medium 12 during printing is arranged on the rear surface (the surface reverse to the surface supporting the recording medium 12) of the platen 26 at a position opposing the inkjet head 24. The temperature of the recording medium 12 can be adjusted to a prescribed temperature during printing, so that the viscosity, surface tension, and other physical properties, of the ink droplets deposited on the recording medium 12, assume prescribed values and it is possible to obtain a desired dot diameter. According to requirements, the print unit can be provided with a pre-adjustment unit 52 and/or a post-adjustment unit 54 for adjusting the temperature of the recording medium 12 respectively on the upstream side and the downstream side of the temperature adjustment unit 50.

[Inkjet Head]

Figure 13:
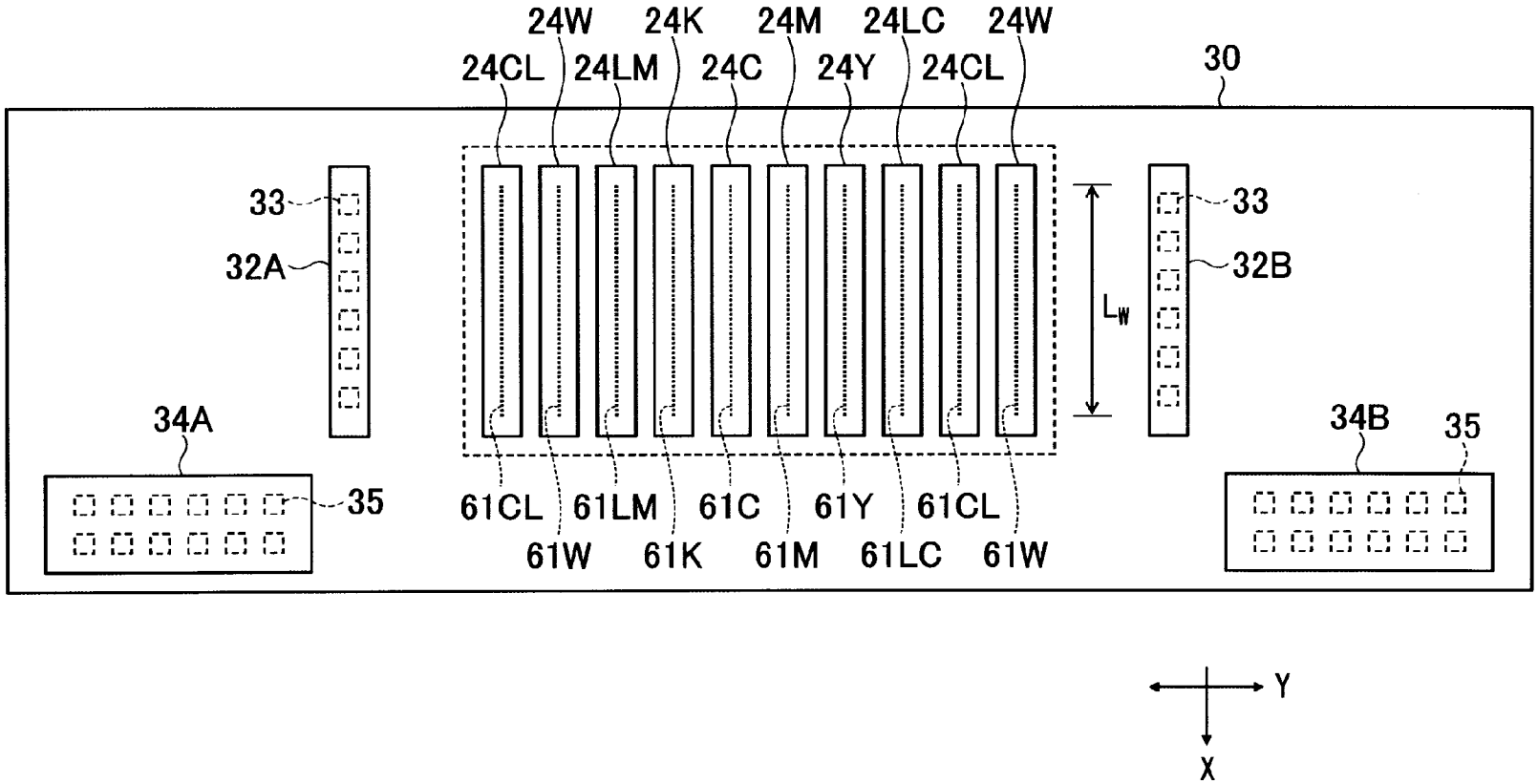
FIG. 13 is a plan perspective view showing arrangement of an inkjet head, a provisional curing light source, and a main curing light source.

FIG. 13 is a plan perspective view showing an example of the arrangement of the inkjet head 24, the provisional curing light sources 32A and 32B and the main curing light sources 34A and 34B, which are arranged on the carriage 30.

The inkjet head 24 has nozzle rows 61CL, 61W, 61LM, 61K, 61C, 61M, 61Y, 61LC, 61CL, and 61W for ejecting droplets of the inks in the color of CL, W, LM, K, C, M, Y, and LC, respectively. In FIG. 13, the nozzle rows are represented as dotted lines, and individual nozzles are not depicted. In the following description, the nozzle rows 61CL, 61W, 61LM, 61K, 61C, 61M, 61Y, 61LC, 61CL, and 61W may be referred to generally as the nozzle rows 61.

The types of the ink colors (number of colors) and the combination of the ink colors are not limited to the present embodiment. For example, it is also possible to adopt a mode where the LC and LM nozzle rows are omitted, a mode where the CL and W nozzle rows are omitted, or a mode where a nozzle row for ejecting an ink of a special color is added. Moreover, the arrangement sequence in the Y direction of the nozzle rows of the respective colors is not limited in particular.

The inkjet head 24 capable of color image formation can be composed by forming head modules for the nozzle rows 61 of the respective colors and arranging the head modules together. For example, it is possible to adopt a mode in which the head modules 24CL, 24W, 24LM, 24K, 24C, 24M, 24Y, and 24LC having the nozzle rows 61CL, 61W, 61LM, 61K, 61C, 61M, 61Y, and 61LC, respectively, are arranged at regular intervals in the Y direction of the carriage 30.

The head modules 24CL, 24W, 24LM, 24K, 24C, 24M, 24Y, and 24LC of the respective colors can be interpreted respectively as the "inkjet head". Alternatively, it is also possible to adopt a configuration in which the ink flow channels are divided for the inks of the respective colors inside one inkjet head 24, and the nozzle rows for ejecting the inks of the respective colors are arranged in the one head.

In each of the nozzle rows 61, a plurality of nozzles are arranged in one row (on one straight line) along the X direction at regular intervals. In the inkjet head 24 according to the present embodiment, the arrangement pitch of the nozzles constituting each nozzle row 61 (nozzle pitch) is 254 μm (100 dpi), the number of the nozzles constituting each nozzle row 61 is 256, and the total length Lw (corresponding to "a nozzle row length" and also referred to as "a nozzle row width") of each nozzle row 61 is approximately 65 mm (254 μm×255=64.8 mm).

In the nozzle rows 61LM, 61K, 61C, 61M, 61Y, and 61LC, the respective nozzles are arranged so as to be shifted from each other in the X direction, so that the nozzle row 61K which ejects the K ink with the lowest cure sensitivity and the nozzle row 61Y which ejects the Y ink with the second lowest cure sensitivity are arranged in this order from upstream to downstream in the medium conveyance direction. Moreover, the nozzles of the LM ink and the LC ink, which are light inks, are placed in between the nozzles of the Y ink, the C ink, and the M ink which are thick inks (see FIG. 3). The thick inks with lower cure sensitivity may be arranged on the more upstream side in the medium conveyance direction.

The ejection frequency is 15 kHz, and droplets of volumes of three types, 10 picoliters (pl), 20 pl and 30 pl, can be selectively ejected, by changing the drive waveforms. That is, dots with three types of sizes, including a small dot, a middle dot, and a large dot, can be formed.

The ink ejection method adopted for the inkjet head 24 is a method (piezo jet method) which ejects a droplet of ink by deformation of a piezoelectric element (piezo actuator). For the ejection energy generating element, apart from an electrostatic actuator (electrostatic actuator method), it is also possible to employ a heat generator such as a heater (heating element) which generates bubbles by heating ink to eject a droplet of the ink by the pressure of the bubbles (thermal jetmethod).

[Arrangement of Ultraviolet Irradiation Apparatus]

As shown in FIG. 13, the provisional curing light sources 32A and 32B are disposed on both the right and left sides of the inkjet head 24 in the scanning direction (Y direction). Furthermore, the main curing light sources 34A and 34B are disposed on the downstream side of the inkjet head 24 in the recording medium conveyance direction (X direction).

The ink droplets having been ejected from the nozzles of the inkjet head 24 and deposited on the recording medium 12 are irradiated with UV light for the provisional curing by the provisional curing light source 32A (or 32B) that passes over the ink droplets immediately after the deposition on the recording medium 12. Furthermore, the ink droplets on the recording medium 12 which has passed through the print region of the inkjet head 24 due to the intermittent conveyance of the recording medium 12 are irradiated with UV light for the main curing by the main curing light sources 34A and 34B.

The provisional curing light sources 32A and 32B and the main curing light sources 34A and 34B may constantly be in a turned-on state during print operation of the inkjet recording apparatus 10, or may be controlled to be turned on and off suitably according to requirements.

[Configuration Example of Provisional Curing Light Source]

As shown in FIG. 13, the provisional curing light sources 32A and 32B are each configured as an array of a plurality of UV-LED elements 33. These two provisional curing light sources 32A and 32B share the same configuration. Although the LED element array made up of six UV-LED elements 33 arrayed in a row along the X direction has been illustrated as the configuration of the provisional curing light sources 32A and 32B in this example, the LED elements and the arrangement configuration thereof are not limited to the example disclosed. For example, it is possible to adopt the configuration in which a plurality of LED elements are arranged in a matrix form in X/Y directions.

These six UV-LED elements 33 are arrayed so that a whole of the region having the same width as the nozzle row width Lw of the inkjet head 24 may be irradiated with UV light at once.

[Configuration Example of Main Curing Light Source]

As shown in FIG. 13, the main curing light sources 34A and 34B are each configured as an array of a plurality of UV-LED elements 35. These two main curing light sources 34A and 34B share the same configuration. In this example, there is illustrated an LED element array (6×2) including six UV-LED elements 35 and two UV-LED elements 35 being arranged, respectively, in the Y direction and X direction in a matrix form as the main curing light sources 34A and 34B.

The arrangement of the UV-LED elements 35 in the X direction, which relates to a later-described swath width, is determined so that in one scanning action by the carriage 30, a whole of a region with the width corresponding to 1/n (n being positive integer) of the nozzle row width Lw may be irradiated all at once with UV light. In the example of FIG. 13, the UV-LED elements 35 are arranged so that a whole of the region with the width of ½ (n=2) of the nozzle row width Lw may be irradiated all at once.

The number of the LED elements and the array configuration thereof in the main curing light source are not limited to those in the example of FIG. 13. As the light sources of the provisional curing light sources 32A and 32B and the main curing light sources 34A and 34B, not only the UV-LED elements 33 and 35 but also UV lamps or the like may be used.

[Image Formation Mode]

The thus-configured inkjet recording apparatus 10 employs multi-pass image formation control, and the print resolution can be varied by changing the number of printing passes. For example, three image formation modes are used: high-productivity mode, standard mode and high-quality mode, and the print resolutions are different in the respective modes. It is possible to select the image formation mode in accordance with the print objective and application.

In the high-productivity mode, printing is carried out at the resolution of 600 dpi (in the main scanning direction)×400 dpi (in the sub-scanning direction). In the high-productivity mode, the resolution of 600 dpi is achieved by two passes (two scanning actions) in the main scanning direction. First, in the first scan (while the outbound movement of the carriage 30), dots are formed at the resolution of 300 dpi. In the second scan (while the inbound movement of the carriage 30), dots are formed at the resolution of 300 dpi so as to be interpolated between the dots having been formed in the first scan (while the outbound movement), and the resolution of 600 dpi is obtained in the main scanning direction.

With respect to the sub-scanning direction, since the nozzle pitch is 100 dpi, and one main scanning action (one pass) can form dots at the resolution of 100 dpi in the sub-scanning direction. Consequently, the resolution of 400 dpi is achieved by interpolation printing of four passes (four scans).

In this specification, a product between the number of passes in the main scanning direction and the number of passes in the sub-scanning direction is referred to as the number of passes in a pertinent image formation mode. Therefore, the number of passes in the high-productivity mode is equal to 2 main scan pass printing×4 sub-scan pass printing=8 passes.

In the standard mode, printing is carried out at the resolution of 600 dpi×800 dpi. This resolution is obtained by setting two-pass printing in the main scanning direction and eight-pass printing in the sub-scanning direction. In other words, the number of passes in the standard mode is equal to 2 main scan pass printing×8 sub-scan pass printing=16 passes.

In the high-quality mode, printing is carried out at the resolution of 1200 dpi×1200 dpi, which is achieved by means of printing of four passes in the main scanning direction and twelve passes in the sub-scanning direction. In other words, the number of passes in the high-quality mode is equal to 4 main scan pass printing×12 sub-scan pass printing=48 passes.

[Ink Supply System]

Figure 14:
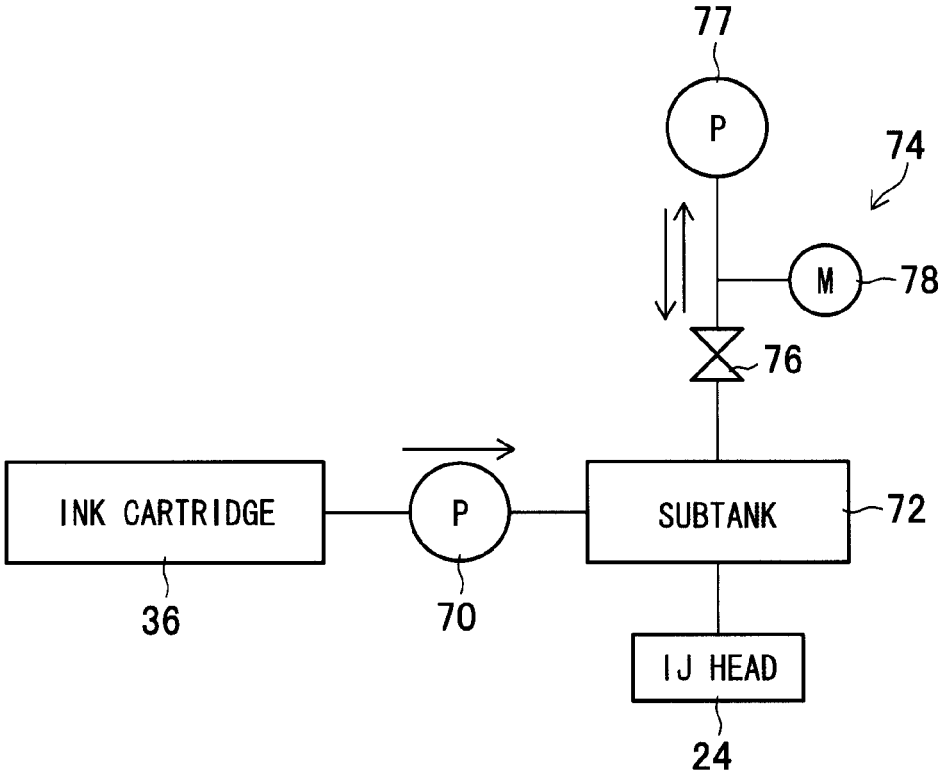
FIG. 14 is a block diagram showing configuration of an ink supply system in the inkjet recording apparatus.

FIG. 14 is a block diagram showing configuration of an ink supply system in the inkjet recording apparatus 10. As shown in FIG. 14, the inks housed in the ink cartridge 36 are sucked by a feed pump 70, and is sent to the inkjet head 24 via a subtank 72. The subtank 72 is provided with a pressure regulation unit 74 for regulating the pressure of the inks inside the subtank 72.

The pressure regulation unit 74 includes a pressure adjustable pump 77 that communicates with the subtank 72 via a valve 76 and a manometer 78 provided between the valve 76 and the pressure adjustable pump 77.

In general printing operation, the pressure adjustable pump 77 is operated in the direction of sucking the inks inside the subtank 72, so that the internal pressure of the subtank 72 and the internal pressure of the inkjet head 24 are maintained as negative pressure. In maintenance operation of the inkjet head 24, the pressure adjustable pump 77 is operated in the direction of pressurizing the inks in the subtank 72 so that pressure is forcibly applied to the inside of the subtank 72 and the inside of the inkjet head 24, and the inks in the inkjet head 24 are discharged via a nozzle. The inks forcibly discharged from the inkjet head 24 are gathered in the aforementioned ink receptacle of the cap (not shown).

[Control System of Inkjet Recording Apparatus]

Figure 15:
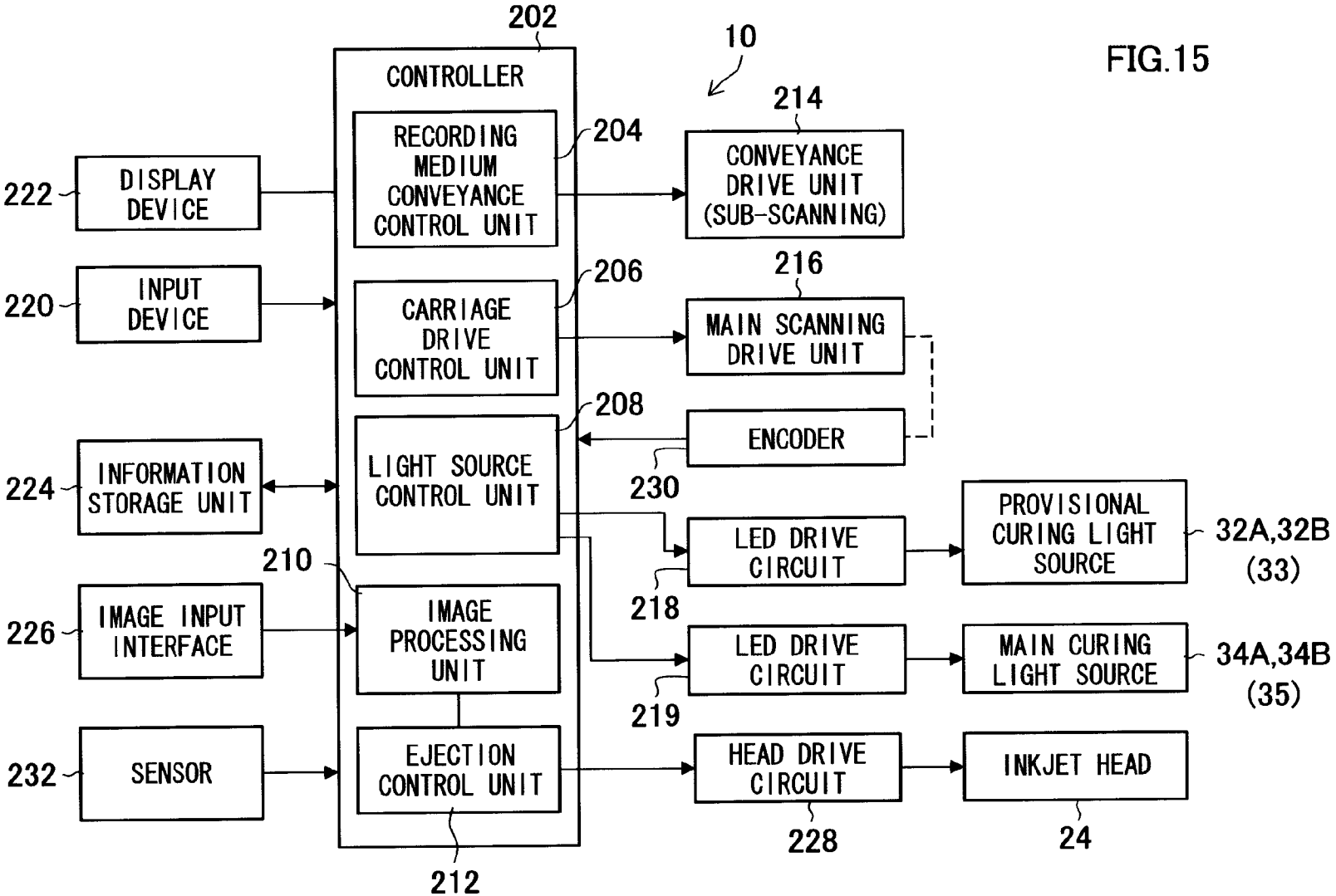
FIG. 15 is a block diagram showing configuration of the inkjet recording apparatus.

FIG. 15 is a block diagram showing configuration of the inkjet recording apparatus 10. As shown in FIG. 15, the inkjet recording apparatus 10 is provided with a controller 202 as a control device. For the controller 202, it is possible to use, for example, a computer equipped with a central processing unit (CPU), or the like. The controller 202, which is equivalent to the control unit 138 shown in FIG. 2, functions as a control device for controlling the whole of the inkjet recording apparatus 10 in accordance with prescribed programs, as well as functions as a calculation device for performing respective calculations. The controller 202 includes a recording medium conveyance control unit 204, a carriage drive control unit 206, a light source control unit 208, an image processing unit 210, and an ejection control unit 212. Each of these units is achieved by a hardware circuit or software, or a combination of these.

The recording medium conveyance control unit 204 controls a conveyance drive unit 214 for conveying the recording medium 12 (see FIG. 11). The conveyance drive unit 214, which is equivalent to the conveying mechanism 132 shown in FIG. 2, includes a drive motor which drives the nip rollers 40 shown in FIG. 12, and a drive circuit thereof. The recording medium 12 which is conveyed on the platen 26 (see FIG. 11) is conveyed intermittently in a unit of the swath width in the sub-scanning direction, in accordance with a reciprocal scanning action (printing pass action) in the main scanning direction performed by the inkjet head 24.

The carriage drive control unit 206 shown in FIG. 15 controls a main scanning drive unit 216 for moving the carriage 30 (see FIG. 11) in the main scanning direction. The main scanning drive unit 216, which is equivalent to the scanning mechanism 130 shown in FIG. 2, includes a drive motor which is connected to a movement mechanism of the carriage 30, and a control circuit thereof.

The light source control unit 208 is a control device which controls the amount of light emission by the UV-LED elements 33 of the provisional curing light sources 32A and 32B through an LED drive circuit 218, as well as controls the amount of light emission by the UV-LED elements 35 of the main curing light sources 34A and 34B through an LED drive circuit 219.

The LED drive circuit 218 outputs voltage of a voltage value corresponding to a command from the light source control unit 208, and adjusts the amount of light emission by the UV-LED elements 33. The LED drive circuit 219 outputs voltage of a voltage value corresponding to a command from the light source control unit 208, and adjusts the amount of light emission by the UV-LED elements 35. Adjustment of the amount of light emission from the LEDs may be achieved not by changing the voltage but by changing a Duty ratio of a drive waveform with use of PWM (Pulse Width Modulation), or by changing both the voltage value and the Duty ratio.

An input device 220, such as an operating panel, and a display device 222 are connected to the controller 202.

The input device 220 is a device by which external operating signals are manually inputted to the controller 202, and can employ various modes, such as a keyboard, a mouse, a touch panel, operating buttons, or the like. The display device 222 can employ various modes, such as a liquid crystal display (LCD), an organic electroluminescence (EL) display, a cathode ray tube (CRT), or the like. An operator is able to select an image formation mode, input print conditions, and input and edit additional conditions, and the like, by operating the input device 220, and is able to confirm the input details and various information such as search results, through the display on the display device 222.

Furthermore, the inkjet recording apparatus 10 is provided with an information storage unit 224, which stores various information, and an image input interface 226 for acquiring image data for printing. It is possible to employ a serial interface or a parallel interface for the image input interface. It is also possible that the image input interface is provided with a buffer memory (not shown) for achieving high-speed communications.

The image data inputted through the image input interface 226 is converted into data for printing (dot data) by the image processing unit 210. In general, the dot data is generated by subjecting the multiple-tone image data to color conversion processing and half-toning processing.

The method for carrying out the half-toning processing can employ commonly known methods of various kinds, such as an error diffusion method, a dithering method, a threshold value matrix method, a density pattern method, and the like. The half-toning processing generally converts tonal image data having M values ($M \geq 3$) into tonal image data having N values ($N < M$). In the simplest example, the image data is converted into dot image data having 2 values (dot on/off), but in a half-toning processing, it is also possible to perform quantization in multiple values which correspond to different types of dot sizes (for example, three types of dots: a large dot, a medium dot and a small dot).

The binary or multiple-value image data (dot data) obtained in this way is used for "driving (on)" or "not driving (off)" the respective nozzles, or in the case of multiple-value data, is also used as ink ejection data (droplet control data) for controlling the ejected droplet volumes (dot sizes).

The ejection control unit 212 generates ejection control signals for a head drive circuit 228 in accordance with the dot data generated in the image processing unit 210. Furthermore, the ejection control unit 212 includes an unshown drive waveform generation unit. The drive waveform generation unit is a device which generates a drive voltage signal for driving the ejection energy generation elements (in this example, the piezoelectric elements) which correspond to the respective nozzles of the inkjet head 24.

The waveform data of the drive voltage signal is previously stored in the information storage unit 224 and waveform data to be used is outputted as and when required. The signal (drive waveform) outputted from the drive waveform generation unit is supplied to the head drive circuit 228. The signal outputted from the drive waveform generation unit can be digital waveform data or an analog voltage signal.

A common drive voltage signal is applied to the ejection energy generation devices of the inkjet head 24 though the head drive circuit 228 while switching elements (not shown) connected to the individual electrodes of the energy generating elements are turned on and off in accordance with the ejection timings of the respective nozzles, so that droplets of the ink are ejected from the corresponding nozzles.

Programs to be executed by the CPU of the controller 202 and various data required for control purposes are stored in the information storage unit 224. The information storage unit 224 stores resolution settings information corresponding to the image formation mode, the number of passes (number of scanning repetitions), emission amount information for the provisional curing light sources 32A and 32B and the main curing light sources 34A and 34B, and the like.

An encoder 230 is installed on a drive motor which drives the main scanning drive unit 216 and a drive motor which drives the conveyance drive unit 214 to output pulse signals corresponding to the rotation amount and rotation speed of the drive motors, and the outputted pulse signals are sent to the controller 202. Based on the pulse signals outputted from the encoder 230, the position of the carriage 30 and the position of the recording medium 12 (see FIG. 11) are ascertained.

A sensor 232 is installed on the carriage 30, and the width of the recording medium 12 is ascertained in accordance with a sensor signal obtained from the sensor 232.

According to the inkjet recording apparatus 10 configured as shown in the foregoing, the heads of the respective ink colors are each shifted from each other in the range of a nozzle pitch in the recording medium conveyance direction, the heads of the inks with lower sensitivity are arranged on the more upstream side in the recording medium conveyance direction so that the inks with lower sensitivity are laid on lower layers for recording. As a result, it becomes possible to constantly keep the surface layer in a stable state and to reduce uneven glossiness thereby.

Although the above-stated embodiment has been described with an example of image formation with use of UV curing inks, the embodiment may also be applied to the case of using curable inks cured by imparted activation energy. For example, inks cured by an X-ray, a molecular beam, or an ion beam can be used.

The technical scope of the present invention is not limited to the scope described in the embodiments disclosed. The configurations and other characteristics in the respective embodiments may appropriately be combined among the respective embodiments within departing from the spirit of the present invention.

What is claimed is:

1. An inkjet recording apparatus, comprising:

an inkjet head which has nozzle rows having nozzles each of which ejects curable inks cured by imparted activation energy and which are arranged in a first direction at a pitch P, the nozzle rows being N ($N \geq 5$) nozzle rows of every color which eject, respectively, thick inks of four colors including cyan, magenta, yellow and black, and at least one light ink among light inks similar in color tone to the thick inks;

an activation energy imparting device which imparts the activation energy to ink droplets ejected from the nozzles and deposited on a recording surface of a recording medium;

a retention device which disposes and retains the inkjet head and the activation energy imparting device along a second direction orthogonal to the first direction;

a scanning device which causes the retention device and the recording medium to relatively scan in the second direction;

a movement device which causes the retention device and the recording medium to relatively move in the first direction in every scanning action by the scanning device; and a control device which forms an image on the recording surface of the recording medium while causing the inkjet head and the activation energy imparting device retained by the retention device to relatively scan each region of the recording medium; wherein the nozzles in each of the nozzle rows in the inkjet head are arranged so as to be shifted by P/N from each other in the first direction, a nozzle of an ink with lowest cure sensitivity is arranged on a most upstream side in a direction of movement of the recording medium relative to the inkjet head in the first direction, and further a nozzle of the light ink is arranged in between the nozzles of two different thick inks, and the control device causes the image to be formed on the recording surface of the recording medium by causing the inks of the nozzles which are arranged on a more upstream side in the direction of relative movement of the recording medium in the first direction to be laid on layers closer to the recording surface of the recording medium.

2. The inkjet recording apparatus as defined in claim 1, wherein the ink with the lowest cure sensitivity is the black ink.

3. The inkjet recording apparatus as defined in claim 1, wherein in each of the nozzle rows in the inkjet head, a nozzle of an ink of second lowest cure sensitivity is arranged subsequent to the nozzle of the ink of the lowest cure sensitivity from upstream to downstream in the direction of movement of the recording medium relative to the inkjet head.

4. The inkjet recording apparatus as defined in claim 3, wherein the ink with the second lowest cure sensitivity is the yellow ink.

5. The inkjet recording apparatus as defined in claim 1, wherein the inkjet head has nozzle rows which eject, respectively, inks of a light cyan color and a light magenta color as the light inks, the nozzles in each of the nozzle rows in the inkjet head are arranged so as to be shifted by P/6 from each other in the first direction, and the nozzle of the light cyan color or the light magenta color is arranged in between the nozzle of the cyan color and the nozzle of the magenta color, between the nozzle of the magenta color and the nozzle of the yellow color, or between the nozzle of the yellow color and the nozzle of the cyan color.

6. The inkjet recording apparatus as defined in claim 1, wherein in each of the nozzle rows in the inkjet head, nozzles are arranged so as to be shifted from each other in the first direction in ascending order of cure sensitivity of inks from upstream to downstream in the direction of movement of the recording medium relative to the inkjet head.

7. The inkjet recording apparatus as defined in claim 1, wherein the activation energy imparting device imparts the activation energy high enough to imperfectly cure ink droplets deposited on the recording surface of the recording medium in one scanning activity by the scanning device.

8. The inkjet recording apparatus as defined in claim 7, further comprising, a second activation energy imparting device which further imparts activation energy to the ink droplets imparted with the activation energy by the activation energy imparting device so as to completely cure the ink droplets.

9. The inkjet recording apparatus as claimed in claim 8, wherein the retention device retains the second activation energy imparting device on a downstream side in the direction of relative movement of the recording medium.

10. The inkjet recording apparatus as defined in claim 1, wherein the retention device retains the activation energy imparting device on both sides of the inkjet head in the second direction.

11. The inkjet recording apparatus according to claim 1, wherein the activation energy is ultraviolet light.

12. The inkjet recording apparatus as defined in claim 1, wherein the inkjet head has nozzle rows which eject, respectively, inks of clear and white colors, on both sides of the N color nozzle rows in the second direction.

13. A method for controlling an inkjet recording apparatus, the inkjet recording apparatus comprising:

an inkjet head which has nozzle rows having nozzles each of which ejects curable inks cured by imparted activation energy and which are arranged in a first direction at a pitch P, the nozzle rows being N ($N \geq 5$) nozzle rows of every color which eject, respectively, thick inks of four colors including cyan, magenta, yellow and black, and at least one light ink among light inks similar in color tone to the thick inks;

an activation energy imparting device which imparts the activation energy to ink droplets ejected from the nozzles and deposited on a recording surface of a recording medium; and a retention device which disposes and retains the inkjet head and the activation energy imparting device along a second direction orthogonal to the first direction, the method comprising:

an arrangement step of arranging the nozzles in each of the nozzle rows in the inkjet head so as to be shifted by P/N from each other in the first direction, while arranging a nozzle of an ink with lowest cure sensitivity on a most upstream side in the direction of movement of the recording medium relative to the inkjet head in the first direction, and arranging a nozzle of the light ink in between the nozzles of two different thick inks; and a control step of causing an image to be formed on the recording surface of the recording medium while causing the inkjet head and the activation energy imparting device retained by the retention device to relatively scan each region of the recording medium, in which the image is formed on the recording surface of the recording medium by causing the inks of the nozzles which are arranged on a more upstream side in a direction of relative movement of the recording medium in the first direction to be laid on layers closer to the recording surface of the recording medium.

* * * * *